US006561691B1

(12) United States Patent
McCann et al.

(10) Patent No.: US 6,561,691 B1
(45) Date of Patent: May 13, 2003

(54) METHOD AND APPARATUS FOR THE DISTRIBUTION OF ICE

(75) Inventors: Gerald P. McCann, Los Angeles; Donald J. Verley, Lake Hughes; Leonid Zatulovsky, Northridge, all of CA (US); Richard M. Humphreys, Mount Merrion (IR)

(73) Assignee: TMO Enterprises Limited, Dublin (IR)

( * ) Notice: Subject to any disclaimer, the term of this patent is extended or adjusted under 35 U.S.C. 154(b) by 0 days.

(21) Appl. No.: 09/544,233

(22) Filed: Apr. 7, 2000

(51) Int. Cl.[7] ..... B01F 7/00

(52) U.S. Cl. ..... 366/299; 406/135; 406/53; 406/54; 406/56; 406/60; 406/122; 62/344; 62/378; 62/381

(58) Field of Search ..... 198/533, 298; 366/299, 344, 378; 62/381, 53, 54, 55, 56, 60, 122; 406/135

(56) References Cited

U.S. PATENT DOCUMENTS

| | | | | | |
|---|---|---|---|---|---|
| 3,651,656 | A | * | 3/1972 | Esser et al. | 62/137 |
| 3,913,343 | A | * | 10/1975 | Rowland et al. | 62/137 |
| 3,918,266 | A | * | 11/1975 | Gindy et al. | 62/137 |
| 4,055,280 | A | | 10/1977 | Kohl et al. | 222/70 |
| 4,104,889 | A | | 8/1978 | Hoenisch | 62/137 |
| 4,803,847 | A | * | 2/1989 | Koeneman et al. | 62/68 |
| 4,817,827 | A | * | 4/1989 | Kito et al. | 222/238 |
| 5,354,152 | A | | 10/1994 | Reinhardt et al. | 406/3 |
| 5,549,421 | A | * | 8/1996 | Reinhardt et al. | 406/3 |
| 5,660,506 | A | | 8/1997 | Berge et al. | 406/3 |
| 6,167,711 | B1 | * | 1/2001 | Slattery et al. | 62/78 |
| 6,224,297 | B1 | * | 5/2001 | McCann et al. | 406/50 |

* cited by examiner

*Primary Examiner*—Christopher P. Ellis
*Assistant Examiner*—Joe Dillon, Jr.

(57) ABSTRACT

An ice delivery system includes an ice bin with an ice maker thereon. An auger dispenses ice from the bin and agitators within the bin prevent blockage. The agitation may follow a pattern depending on the location of the agitators with some about the periphery less employed than those adjacent the auger. An ice gate receives ice and flowing air to direct the ice pneumatically to a multistation diverter. The flow through the diverter is vertically downwardly. Tubes from the diverter convey ice to remote dispensing stations. The dispensing stations have prechambers with drains and lockable gates to advantageously receive ice for delivery into the remote station bins or block the ice storage area to allow cleaning. Conduit couplings are configured to connect tubing without creating an area of ice blockage or allowing the buildup of contamination. Germicidal lights or ozone may be used in the ice bin to avoid contamination. Further, active agents for cleaning, de-scaling or sanitizing may be introduced through the ice gate on an automatic is cycled basis.

18 Claims, 23 Drawing Sheets

METHOD AND APPARATUS FOR THE DISTRIBUTION OF ICE

BACKGROUND OF THE INVENTION

The field of the present invention is pneumatic ice distribution to dispensing stations.

Apparatus and methods for distributing ice to remote stations have been developed, particularly for use in the food service industry. Such systems incorporate a central ice bin, transport conduits, remote dispensing stations and a source of pneumatic energy to move the ice from the central bin to the dispensing stations. One such system is illustrated in U.S. Pat. No. 5,549,421, the disclosure of which is incorporated herein by reference.

In designing such systems, important considerations include enhancing ice flow, maintaining the integrity of the ice in a frozen state and avoiding contamination. In operating such systems, ice has been found to have a tendency to stick together and form blockages in the handling system. Avoidance of such blockages and the proper handling of a blockage when it does occur are of critical importance to the reliability to such systems. Maintaining the ice in an appropriate frozen state is also important. Localized thawing followed by re-freezing encourages the agglomeration of pieces of ice, resulting in blockage and inappropriate dispensing. The quality of the ice dispensed also is dependent upon the appropriate maintenance of uniform temperatures. Contamination has been a problem in such systems. Ice bins form a convenient source for manually taking scoops of ice. Further, placing foreign objects, such as glasses and bowls, in the ice for chilling has also been found to be a common, if inappropriate, use of ice bins. Resolutions of these issues is necessary for public safety and commercial acceptance of such systems.

SUMMARY OF THE INVENTION

The present invention is directed to an ice delivery system including various mechanical components therefor and modes of operation.

In a first separate aspect of the present invention, the ice delivery system includes a source of ice, an ice bin and two sets of at least one agitator each. Each set of at least one agitator includes a periodic cycle. The frequency of the periodic cycle of the set closest to the bin outlet is substantially greater than the frequency of the periodic cycle of the other set. Ice is thus able to move through the bin without bridging or blockage and, at the same time, without being excessively stirred.

In a second separate aspect of the present invention, the ice delivery system of the first aspect may have a ratio of frequencies between sets of 10:1. Additionally, the agitators may move less than one full revolution for each periodic cycle. The bin may have a V-bottom with an augur located at the convergence of the V-bottom. Various agitator configurations are contemplated. Agitators adjacent to the augur may include augur elements oriented to move ice away from the outlet. The augur may be of increasing pitch toward the bin outlet. Each contributes to consistent flow through the bin and discharge.

In a third separate aspect of the present invention, an ice delivery system includes an ice bin with a channel in the bottom thereof leading to an outlet. The outlet has a larger horizontal major cross-sectional dimension than the channel. An augur is rotatably mounted in the channel. The augur may extend outwardly of the ice outlet. Reduced blockage is contemplated. A breaker element may be arranged adjacent the augur outwardly of the ice outlet to avoid further any ice buildup.

In a fourth separate aspect of the present invention, an ice delivery system includes a multi-station diverter. The diverter is associated with an ice transport conduit and with distribution conduits which extend to a plurality of receiving stations. The ice transport conduit extends downwardly to the diverter while the distribution conduits extend downwardly from the diverter at the portions of those conduits adjacent the diverter. This orientation of the conduits avoids ice blockage in the diverter. The downward orientation of the conduits may additionally be vertical to further inhibit ice blockage.

In a fifth separate aspect of the present invention, the ice delivery system includes a multi-station diverter including a rotatably mounted diverter tube which has an inlet end concentric with the axis of rotation and an outlet end displaced from the axis by a fixed distance. A transport conduit is associated with the inlet end while distribution conduits are placed about the axis of rotation at the same distance as the outlet end of the diverter tube. A conduit is thus presented through the diverter matching up with the incoming transport conduit and the outgoing distribution conduits.

In a sixth separate aspect of the present invention, the multi-station diverter of the fifth separate aspect is contemplated to include further a support for the diverter tube which has sockets cooperating with an actuated pin to properly align the diverter tube with the distribution conduit inlets. Station markers may be associated with the support to provide input to a controller for properly locating the diverter tube.

In a seventh separate aspect of the present invention, the ice delivery system includes an air directional valve and a source of constant transporting air. The valve includes valve elements which selectively open to alternatively supply air to an ice transport conduit and to exhaust. In this way, the source of constant transporting air may be rapidly applied and rapidly diverted from the pneumatic conveyor.

In an eighth separate aspect of the present invention, the ice delivery system includes an ice transport conduit, a controlled source of transporting air and an ice gate which includes a substantially vertically extending passage, an ice inlet open laterally into the passage, an air inlet open into the passage below the ice inlet and an ice and air outlet below the air inlet. A gate in the passage has two extreme positions. One of the positions closes off the ice inlet to avoid air flow toward the ice inlet while the other provides for charging of ice into the transport conduit from the ice inlet.

In a ninth separate aspect of the present invention, the ice delivery system includes an ice bin and receiving stations with a pneumatic system for selectively distributing ice from the ice bin to the receiving stations. Ice level sensors are located in the bin and the receiving stations. A visual ice level monitor is coupled with the bin for maintaining the integrity of ice within the bin. A locking element may further restrict entry.

In a tenth separate aspect of the present invention, an ice delivery system conduit coupling has two end pieces, each with a tubular clamp section and a tubular extension section. The tubular extension sections have inner shoulders facing the tubular clamp sections and have attachments with sealing surfaces. The sealing surfaces are engaged facing one another with a sealing element therebetween. The tubular extension sections each have an inner shoulder facing the tubular clamp sections and inner truncated conical surfaces. One of the inner truncated conical surfaces tapers inwardly from the associated shoulder while the other tapers outwardly from the associated shoulder. The arrangement provides a coupling which is to avoid ice blockage. The tubular clamp sections may optionally be partially split longitudinally and include circumferential channels to receive clamp bands.

In an eleventh separate aspect of the present invention, an ice delivery system conduit coupling includes a coupling tube with a clamp sleeve extending thereover. The clamp sleeve includes longitudinally split ends and circumferential channels about the split ends which may receive clamp bands. The coupling tube fits within the clamp sleeve between annular sealing flanges located on the inner surface of the clamp sleeve. Conduit ends extend between the coupling tube and the clamp sleeve at either end thereof. Sealing and resistance to ice blockage are to be achieved by the annular sealing flanges capable of constricting the conduit to form sealed smooth transitions with the coupling tube.

In a twelfth separate aspect of the present invention, an ice delivery system conduit coupling includes a tubular insert having a flared end on an internal tubular surface and an external surface to receive the end of a conduit. A second portion of the tubular insert may also include a flared end and an external surface to receive another end of a conduit. A passage through the tubular insert may be larger toward the upstream end than toward the downstream end. In appropriate circumstances, a split sleeve may be wrapped about the tubular insert to extend beyond the insert for constricting the tubing for sealing and avoiding ice blockage.

In a thirteenth separate aspect of the present invention, the ice delivery system includes an ice bin with a germicidal aspect. This could be a germicidal light in the ice bin or a source of ozone. The presence of the germicidal light or the ozone is to reduce organic growth within the ice bin which might otherwise contaminate the ice.

In a fourteenth separate aspect of the present invention, the ice delivery system includes a remote dispensing station, a chamber between the distribution conduit and the remote dispensing station with a passageway from the chamber to the station. A gate selectively closes the passage as controlled by a system controller. Closure of the gate can prove advantageous to avoid blowing air, cleaning fluid or a sanitizing device into the remote station.

In a fifteenth separate aspect of the present invention, the ice delivery system of the fourteenth separate aspect might further include a liquid drain at the end of the gate to divert liquid from the receiving station. The gate may be both lockable by the controller in the closed position and independently biased toward the closed position.

In a sixteenth separate aspect of the present invention, the ice delivery system includes a drain at the end of a gate in a passage to a remote dispensing station. The drain exits from the end of the gate with the gate closing the passage. The drain may include a collector extending across the distal end of the gate with an outlet at one edge of the gate. The collector may be a trough in one surface of the gate or the collector may extend through the wall of the passage at the distal end of the gate with the gate in the closed position.

In a seventeenth separate aspect of the present invention, the ice delivery system includes auguring ice from a bin, dropping the ice away from the augur, timing a delay after auguring the ice before closing a gate and blowing transporting air to convey the ice. Where appropriate, the augur may be reversed before closing the gate. This allows ice to properly pass into the transporting area from the ice bin.

In an eighteenth separate aspect of the present invention, the ice delivery system includes auguring ice from an ice bin, dropping the ice away from the augur outside of the bin, closing a gate between the bin and a source of transporting air and sensing the state of closure of that gate. Cycling the action to close the gate until the gate is fully closed helps to clear away any ice blocking complete closure of the gate which might otherwise result in insufficient conveying pressure to convey the ice.

In a nineteenth separate aspect of the present invention, the ice delivery system includes auguring ice from a bin, dropping the ice away from the augur, stopping the augur, closing a gate to the ice bin, storing pressure in a source of transporting air and rapidly releasing that air to blow transporting air and provide an initial boost to provide momentum to the ice being transported.

In a twentieth separate aspect of the present invention, the ice delivery system includes auguring ice from an ice bin and transporting that ice through distribution conduits. The auguring of ice is disabled upon the opening of an access door into the ice bin. Once disabled, upon closure of the ice bin door, a test puff of air may be employed for determining the presence of ice in the distribution system. Maintaining ice bin integrity and reinitializing the distribution system inhibits contamination and avoids system blockage.

In a twenty-first separate aspect of the present invention, the ice delivery system initializes the system upon powering up, either initially or upon restart after system shutdown. The blowing of transporting air is cycled upon the sensing of a predetermined minimum pressure in the ice transport conduit.

In a twenty-second separate aspect of the present invention, the ice delivery system includes testing the system for blockage before auguring ice from the bin and blowing a burst of transporting air through the system before auguring ice upon sensing a pressure above a preset value within the distribution conduit.

In a twenty-third separate aspect of the present invention, the ice delivery system provides for the blowing of transporting air without release of the gate at the remote dispensing station. The blowing of transporting air with the gate closed at the remote station accommodates a drying cycle as well as a cleaning cycle without affecting the ice within the remote station.

In a twenty-fourth separate aspect of the present invention, the gate associated with a remote dispensing station may be employed to sense the state of the remote dispensing station and disable the distribution of ice thereto when appropriate.

In a twenty-fifth separate aspect of the present invention, the ice delivery system includes the mode of blowing drying air through the system to inhibit the growth of contaminating agents.

In a twenty-sixth separate aspect of the present invention, the ice delivery system includes the cycle of transporting ice pneumatically through tubing from an ice bin to a remote dispensing station with a gate to the remote dispensing station closed, adding an active agent to the ice to be transported and blowing air through the tubing and over the transported ice. The active agent may be drained from the ice before entering the remote dispensing station.

In a twenty-seventh separate aspect of the present invention, any of the foregoing aspects are contemplated to be employed in combination.

Accordingly, it is a principal object of the present invention to provide an improved process and the apparatus therefor for distributing ice from a central station. Other and further objects and advantages will appear hereinafter.

DETAILED DESCRIPTION OF THE PREFERRED EMBODIMENTS

Figure 1:
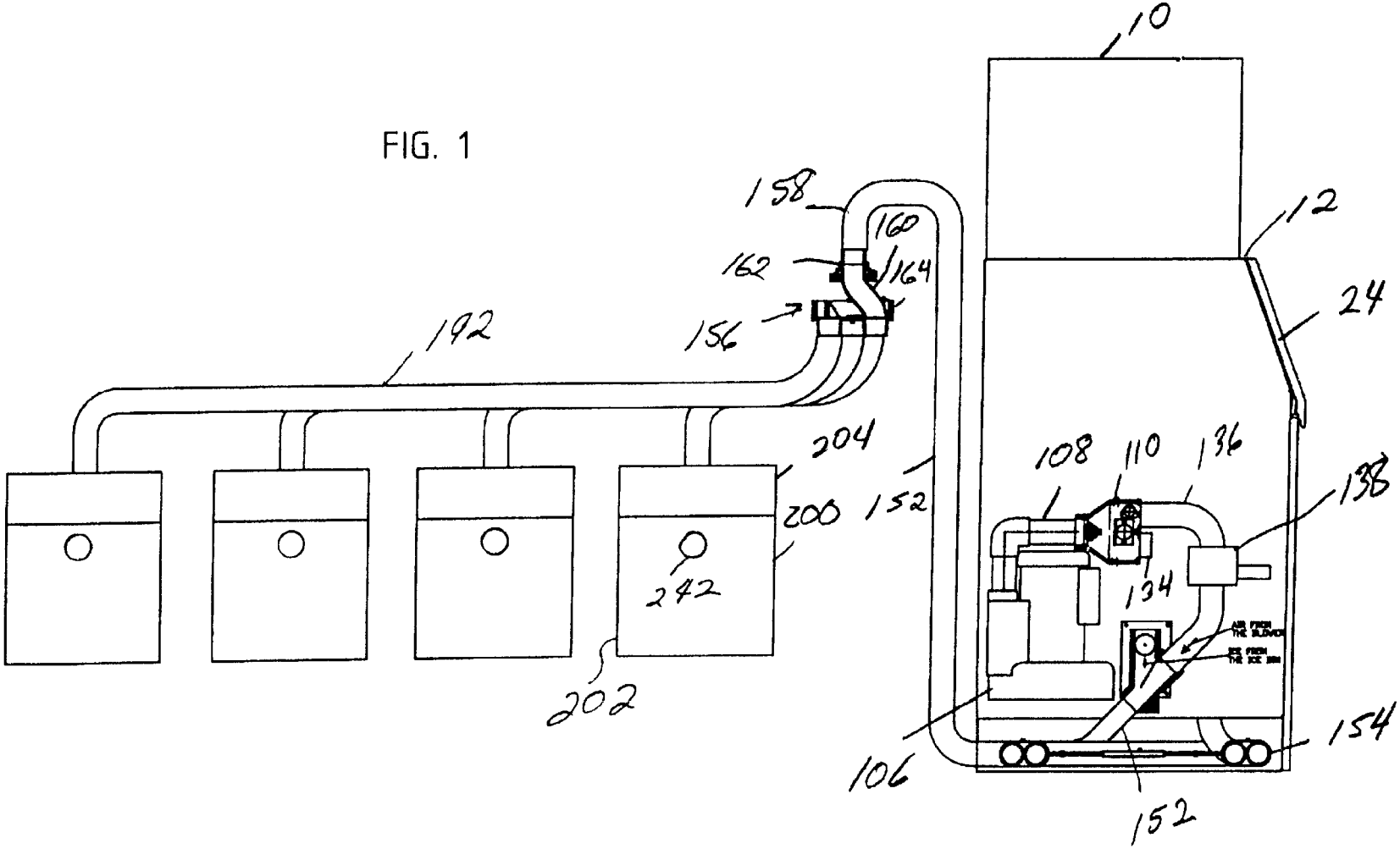
FIG. 1 is a schematic view of a complete ice distribution system.

Turning in detail to the drawings, FIG. 1 illustrates an ice delivery system. The delivery system includes a source of ice 10 above an ice bin 12. The source of ice 10 and the ice bin 12 are further illustrated in FIG. 2. The source of ice 10 is an ice maker mounted to the top of the ice bin 12 with the ice bin 12 forming a mounting platform. An evaporator 18 and the condenser 22 along with the remaining components of the refrigeration system are shown in the ice maker 10 which can deliver ice into the ice bin 12.

Figure 2:
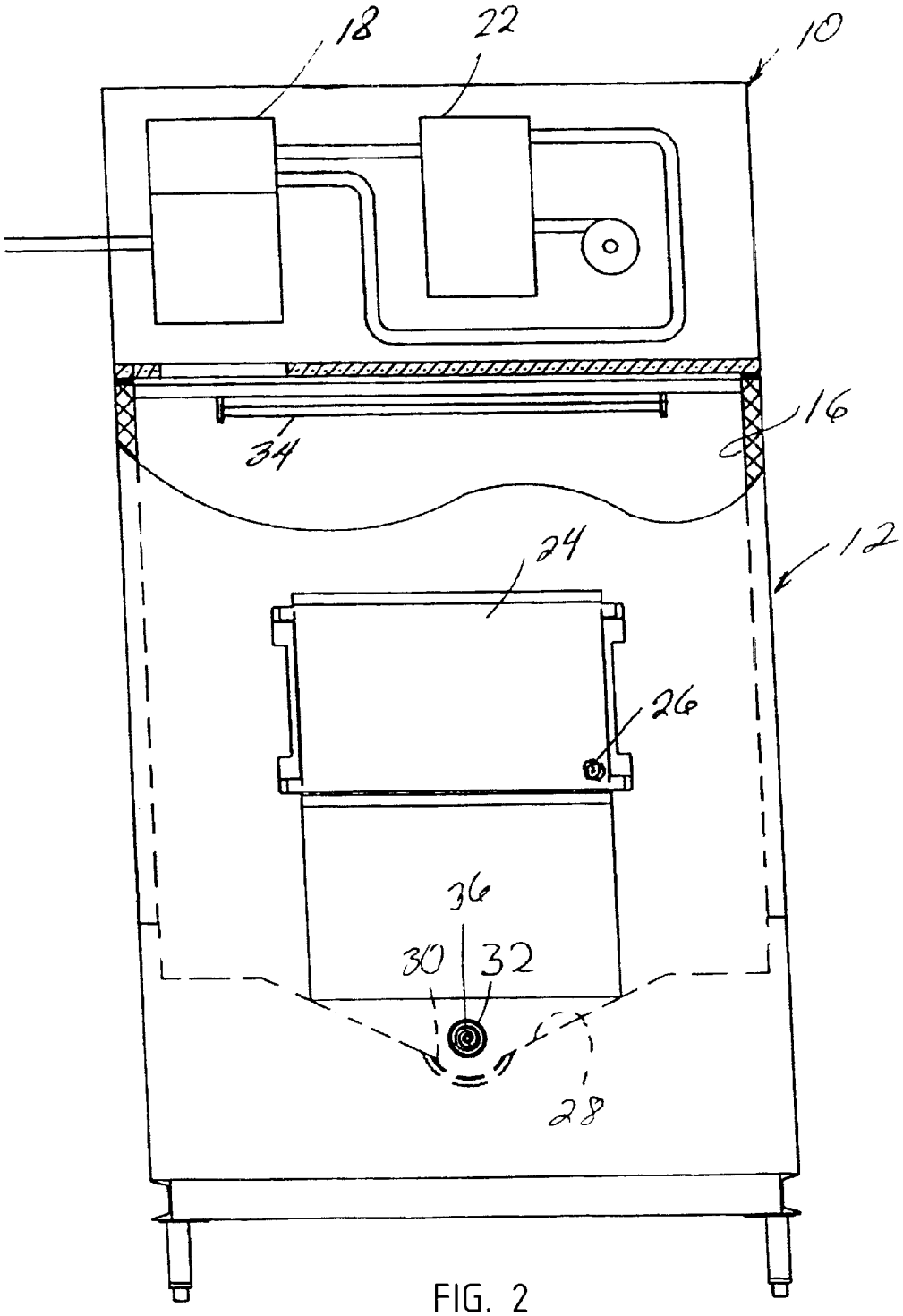
FIG. 2 is a is a front view of an ice bin with a ice maker.

The ice bin 12 includes a hinged door 24 providing access to within the ice storage area 16. The hinged door 24 is preferably hinged from above so as to naturally assume a closed position when released. Although the door 24 may be used for service, it is preferably to remain closed during all operation of the ice delivery system. A locking element 26, retaining the door in the closed position, is preferably employed to prevent access to the ice storage area 16 to restrict entry as a mechanism for inhibiting contamination of the ice. Two different doors 24 are illustrated in FIGS. 1 and 2. As shown in FIG. 2, the location of the door may be such that when opened ice will pour out the door. This is accomplished by having the bottom of the door below the normal level for ice storage. With the device having this configuration, opening the door becomes very problematic and discouraged.

As can be seen from FIGS. 2 through 5, the ice storage area 16 of the ice bin 12 is defined with a V-bottom 28. This bottom 28 further includes a radiused apex to define a channel 30. The channel 30 runs to an ice outlet 32 at the convergence of the V-bottom 28. The ice outlet 32 extending through the wall of the ice bin 12 is preferably the only normally open port in the ice storage area 16 and it only leads into the transport system. The ice outlet 32 is configured to avoid any shoulders or other surfaces intruding into the ice storage area 16 which would prevent movement of the ice. Also contemplated is the radius of the ice outlet 32 being at least as large or larger than the radius defining the interior of the channel 30 to this end. A germicidal light 34 is included within the ice storage area 16. With the ice bin being sealed except through the discharge port 32 into the transport system and with the inclusion of the germicidal light 34, a clean environment is contemplated. Element 34 may also represent an ozone manifold 34 for dispensing germicidal ozone to the same end.

Figure 3:
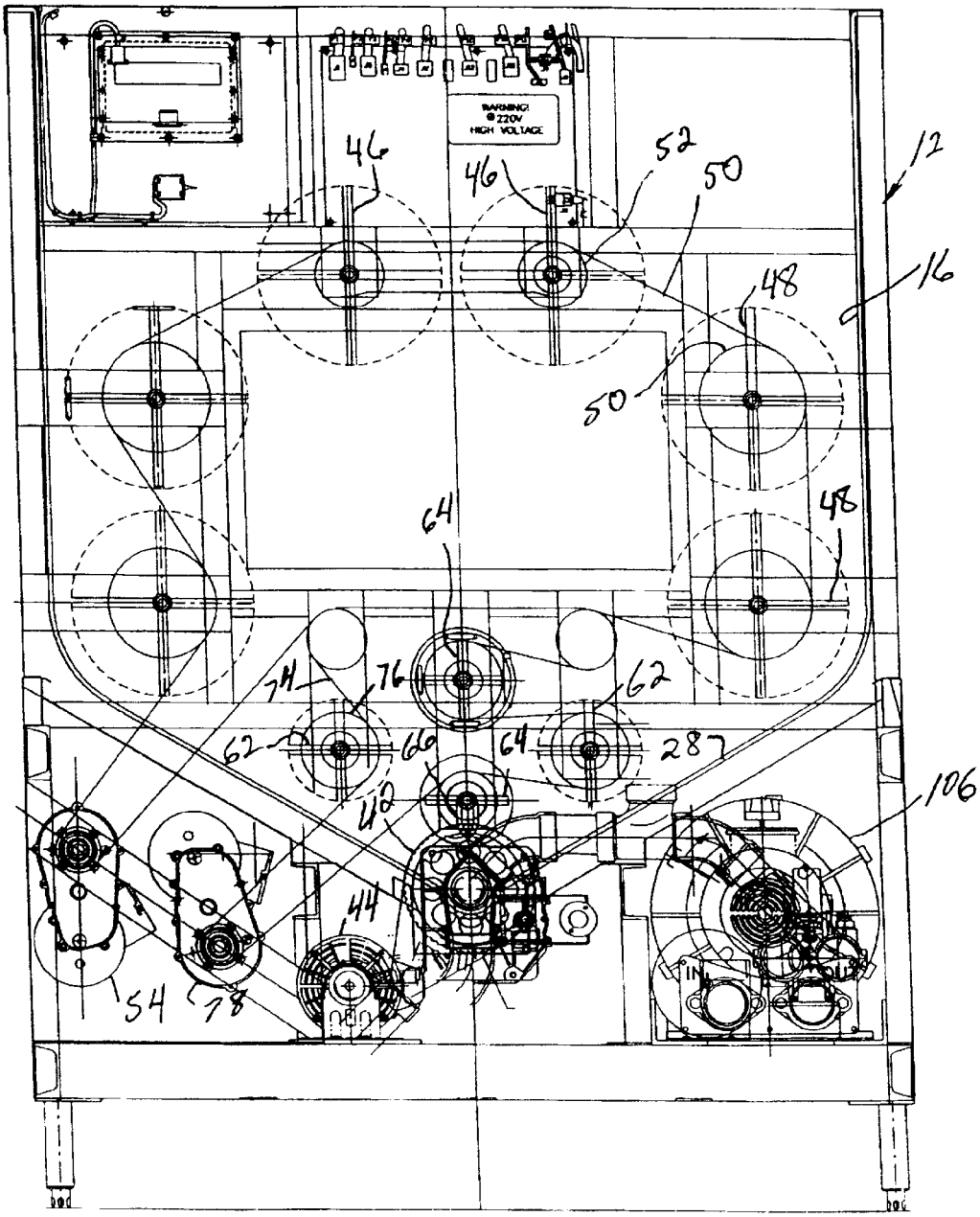
FIG. 3 is a front view of a ice bin with an agitator system.
Figure 4:
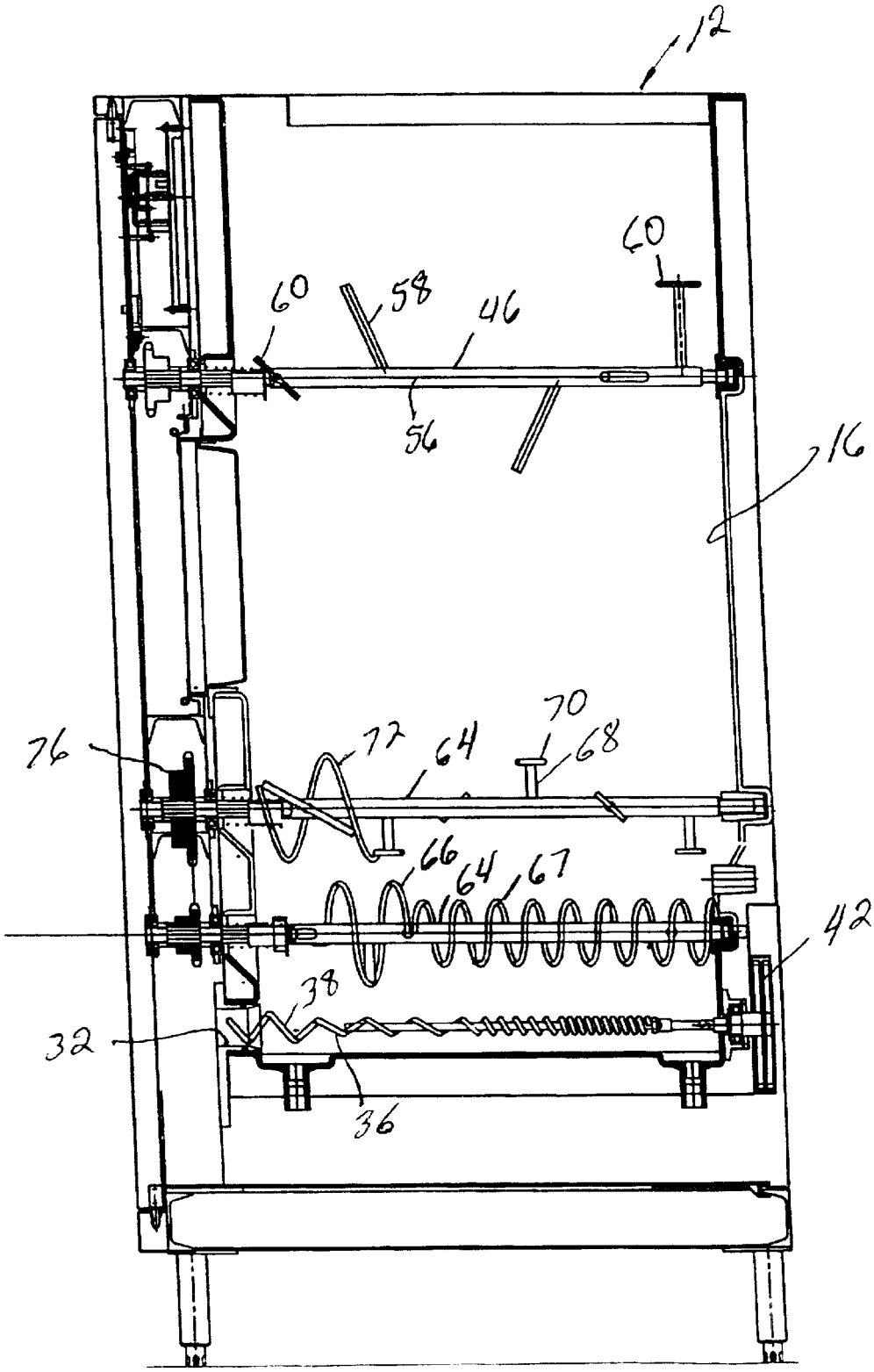
FIG. 4 is a cross-sectional side view of a ice bin with an agitator system.
Figure 5:
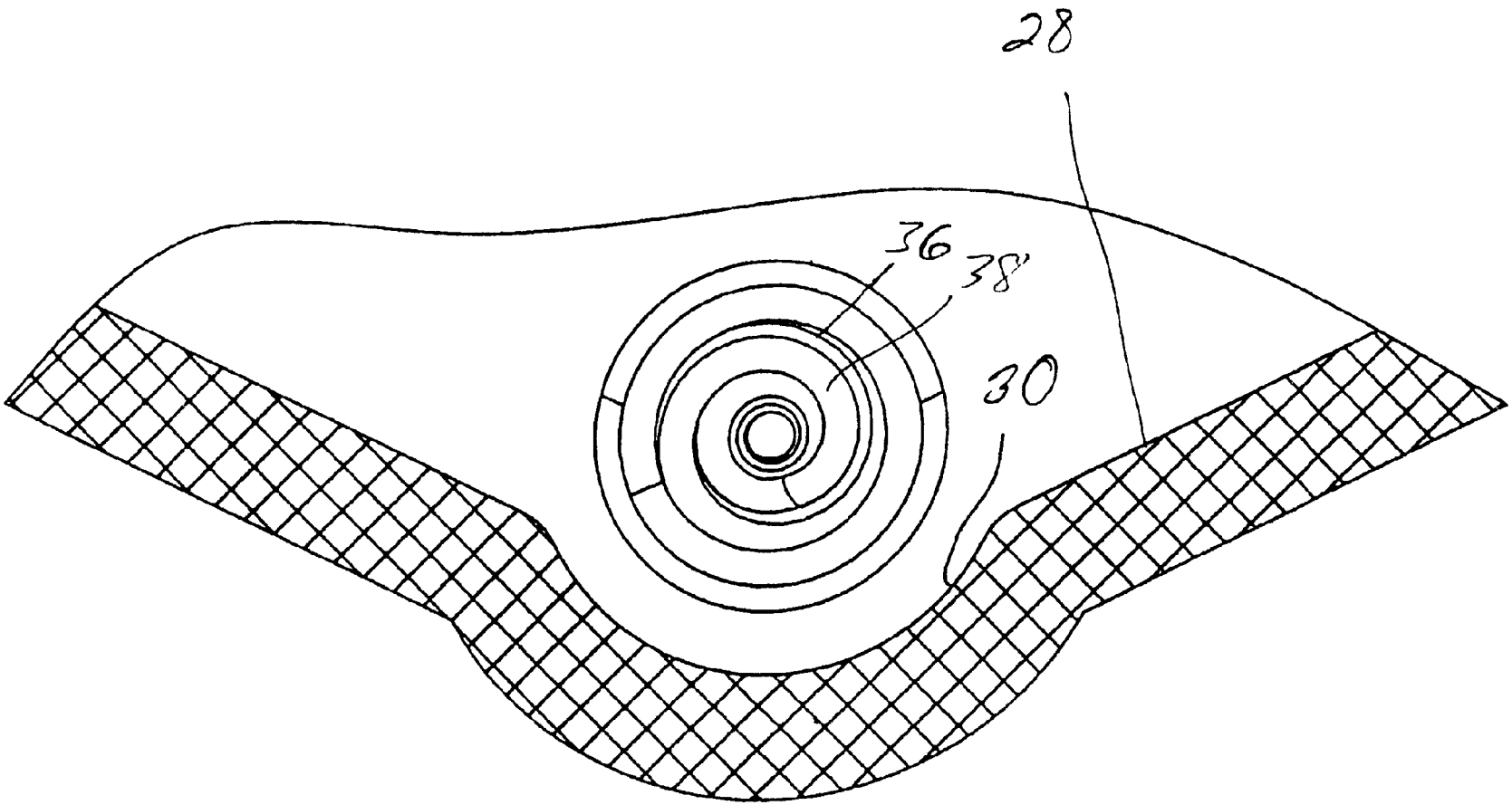
FIG. 5 is a cross-sectional detail end view of an auger in an ice bin.
Figure 8:
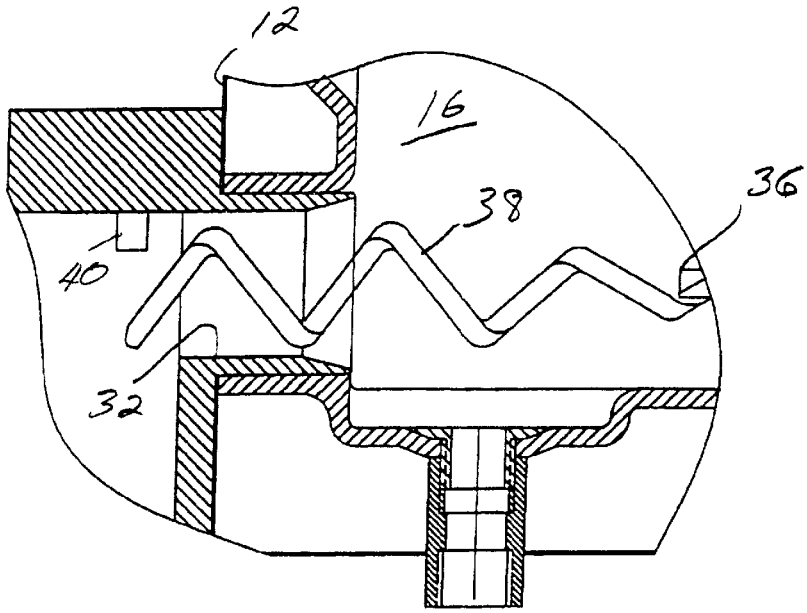
FIG. 8 is a side view of the outlet from the bin.

Positioned substantially concentrically within the channel 30 of the ice storage area 16, an auger 36 is located at the convergence of the V-bottom. The auger 36 includes a flight 38 of increasing pitch to accelerate the ice pieces as they move toward the ice outlet 32. In FIG. 4, the auger 36 is shown to extend only into the ice outlet 32. In FIG. 8, the auger 36 is shown to extend through the ice outlet 32 to insure complete passage from the ice bin. This auger 36 is displaced from the opposed wall of a discharge passage by a dimension greater than the anticipated maximum major dimension of the pieces of ice to be handled. This displacement is intended to avoid ice buildup. A breaker element 40 further insures complete discharge of the ice including its disengagement from the auger 36. The auger 36 is driven from the back of the unit as can be seen in FIG. 4 by a drive wheel 42 which is coupled with a drive motor 44 shown in the layout of FIG. 3.

A set of bin agitators is positioned about the top and sides of the ice storage area 16. This set of agitators includes two upper agitators 46 and two side agitators 48 on each side of the ice storage area 16. This first set of agitators including the two agitators 46 and four agitators 48 are coupled together by an endless elongate flexible element such as a chain or belt 50. Pulleys 52 are engaged by the elongate drive element 50. As can be seen in FIG. 3, the upper agitators 46 are driven more rapidly than the side agitators 48. The drive element 50 also includes a first drive 54 which is a motor with a reduction gear. One of the agitators 46 and 48 is illustrated clearly in FIG. 4 as having a main agitator shaft 56 with bars 58 extending outwardly from the shaft 56. The bars 58 may include cross pieces 60 fixed at the distal end thereof. Such cross pieces are illustrated as being adjacent to the walls of the ice bin 12 in the representative agitator element of FIG. 4.

A set of discharge agitators are arranged more proximate to the auger 36. This second set of agitators includes two agitators 62 which are symmetrically placed in the ice storage area 16 and are equidistant from the V-bottom laterally of the auger 36. The second set further includes two agitators 64, the first of which is placed immediately above the auger 36 while the second is immediately above the first. The agitators 62 and 64 also include elements to agitate the ice contained within the ice bin 12. The lowermost of the agitators 64, directly above the auger 36, includes a helical flight 66 acting as an auger. This flight 66 and the associated shaft is connected with the drive so as to move ice away from the ice outlet 32. A second auger flight 67 of lesser diameter, as seen in FIG. 4, further displaced from the ice outlet 32 moves ice toward the outlet. The uppermost agitator 64 includes bars 68 extending from the shaft with transverse elements 70 arranged at the distal ends thereof. An auger flight 72 also moves ice away from the ice outlet 32. The agitators 62 include bars 68 with transverse elements 70 without an auger flight. Naturally, various combinations of these elements can be employed with each of the agitators 62 and 64. Further, other placement of these agitators might prove equally effective. This second set is, however, positioned about the auger 36 associated with the ice outlet 32 while the agitators 46 and 48 are located about the main cavity of the ice storage area 16. While the second set of agitators 62 and 64 are more involved with the direct feeding of the auger 36 with a conditioning of the ice thereabout, the agitators 46 and 48 operate principally to insure that ice does not bridge across the bin or otherwise fail to appropriately flow toward the V-bottom of the bin.

The second set of agitators 62 and 64 is driven by a second elongate drive element 74 such as a chain or belt. Pulleys 76 couple the shafts of the agitators 62 and 64 to the drive element 74. It may be noted that the pulley 76 around the lowermost of the agitators 64 is smaller, thus driving this agitator at a faster speed. This drive element 74 is coupled with a motor and drive reduction gear 78 to define a second drive for the second set of agitators.

Figure 6:
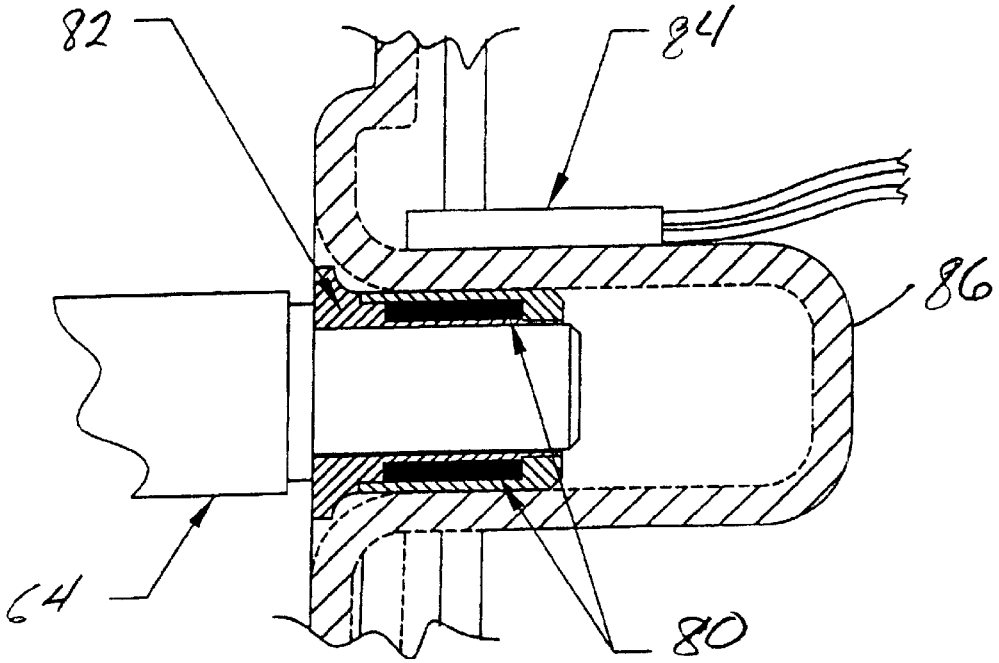
FIG. 6 is a is a cross-sectional side view of a rotation sensor.
Figure 7:
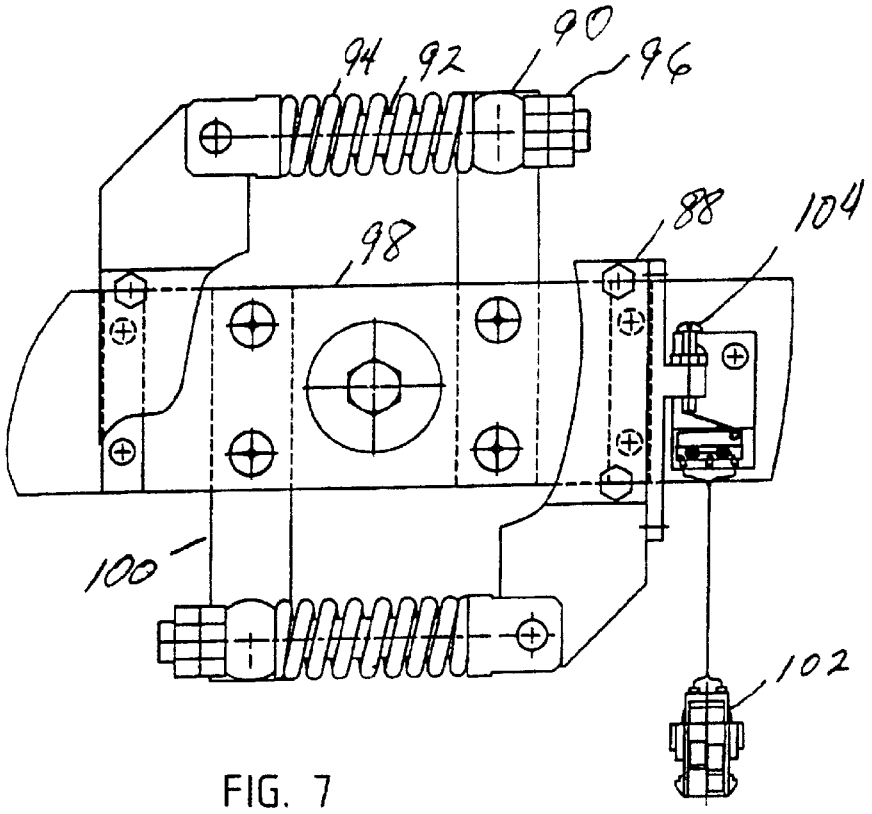
FIG. 7 is a front view of a torque sensor.

FIGS. 6 and 7 illustrate safety mechanisms associated with the agitators 46, 48, 62 and 64 and/or the auger 36. In FIG. 6, a rotation sensor is illustrated which includes permanent magnets 80 located in a coupler 82 fixed to the shaft of one of the agitators or auger. A reed switch 84 is located on the bearing housing 86 to be attracted, and/or repulsed from the permanent magnets 80. When the switch 84 is not actuated by rotation of the permanent magnets 80, a fault can be detected. In FIG. 7, a motor mount operates as a torque sensor. Brackets 88 are fixed to the frame of the ice bin 12. Sliding collars 90 are positioned about mounting shafts 92 between springs 94 and locked nuts 96. A motor mount 98 is coupled with the sliding collars 90 through mounts 100. A microswitch 102 is mounted to the motor mount 98 while an adjustable pin 104 is mounted to one of the brackets 88. Excessive torque compresses the springs 94 sufficiently to actuate the microswitch 102. The signal from the microswitch 102 may be employed to shut down the equipment as the system responds to excessive torque.

Figure 14:
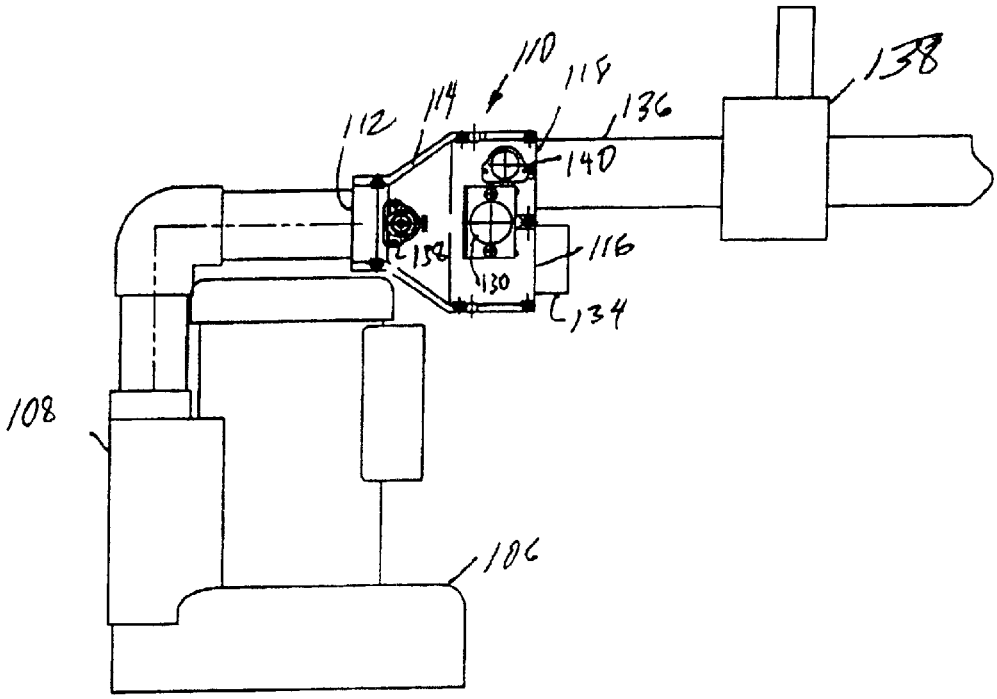
FIG. 14 is a side view of an air valve allowing an air pressure buildup.

Returning to FIG. 1, a source of constant transporting air in the form of a blower 106 is conveniently mounted to the side of the ice bin 12. The blower preferably includes a filter to minimize air contamination. The discharge 108 of the blower is directed to an air directional valve 110. This valve is illustrated in subassembly with the source of constant transporting air such as a blower 106 in FIG. 14 and is further illustrated in greater detail in FIGS. 10 through 13.

The air directional valve 110 includes a valve inlet 112 coupled with the blower 106. The valve 110 includes a transition section 114 which acts as a manifold to direct air to two outlets 116 and 118. The outlets 116 and 118 are controlled by a valve element assembly 120 which includes a first valve element 122 associated with the outlet 116 and a second valve element 124 associated with the outlet 118. The first and second valve elements 122 and 124 are arranged substantially in perpendicular planes about a common axis. A crank 126 fixed to the composite bearing shaft of these valve elements 122 and 124 is coupled with a link 128 controlled by a solenoid 130 and a return spring 132.

When the solenoid 130 is actuated in the air directional valve 110, the first outlet 116 is closed by the first valve element 122. When the solenoid is deactivated, the return spring 132 causes the valve element assembly 120 to rotate so that the second valve element 124 closes the outlet 118. When one of the first and second elements 122 and 124 is closed, the other is fully open. The first outlet 116 exhausts from the system through an outlet 134. The outlet 118 is ultimately coupled to an ice transport conduit through an air supply passage 136. A high pressure switch 138 is located near the inlet 112 while a low pressure switch 140 is located at the outlet 118 to monitor the state of the system. With the blower 106 acting as a constant supply of pressurized air, the system may have the blower continuously operating or bring the blower up to speed before pneumatic transporting is undertaken. In either case, when the blower 106 is fully operating, the valve element assembly 120 may be actuated by the solenoid 130 to redirect air from exhaust thought the outlet 134 to the system through the air supply passage 136.

To further insure an immediate burst of air into the system, a second valve 138 may be interposed within the air supply passage 136. This valve may also employ a butterfly valve plate which can be rapidly opened to release the air pressurized by the blower 106 and directed by the air directional valve 110 into the air supply passage 136.

Figure 9:
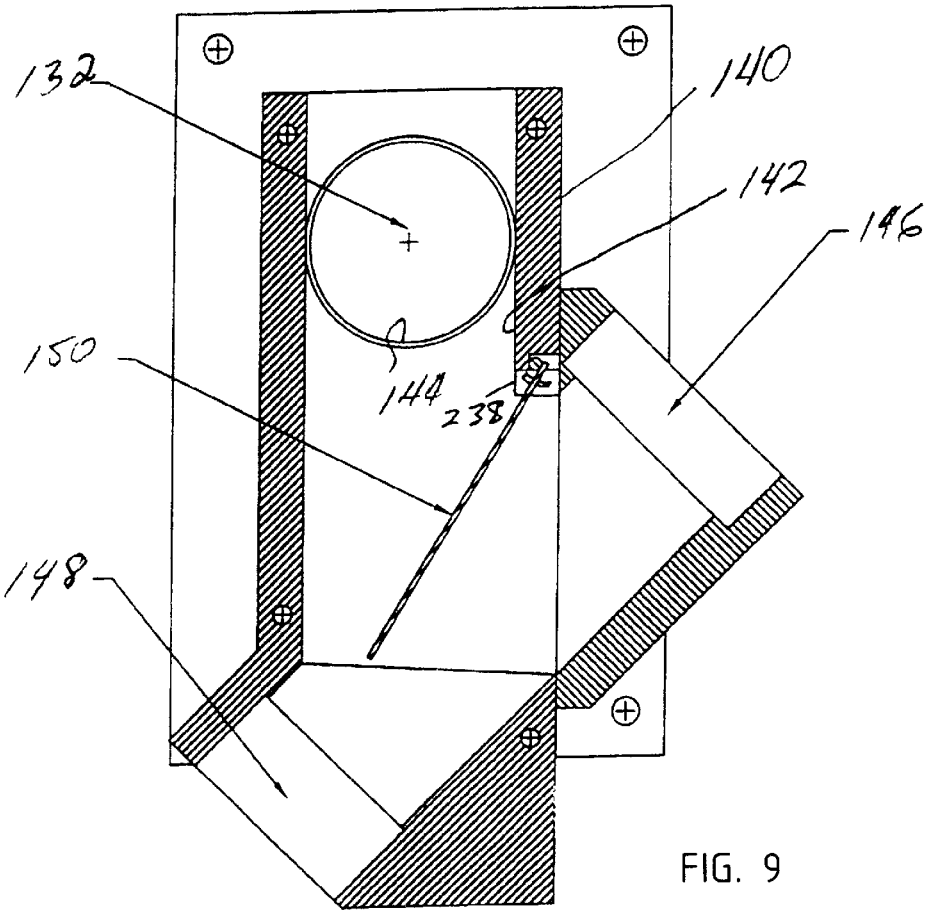
FIG. 9 is a cross-sectional side view of an ice gate.
Figure 10:
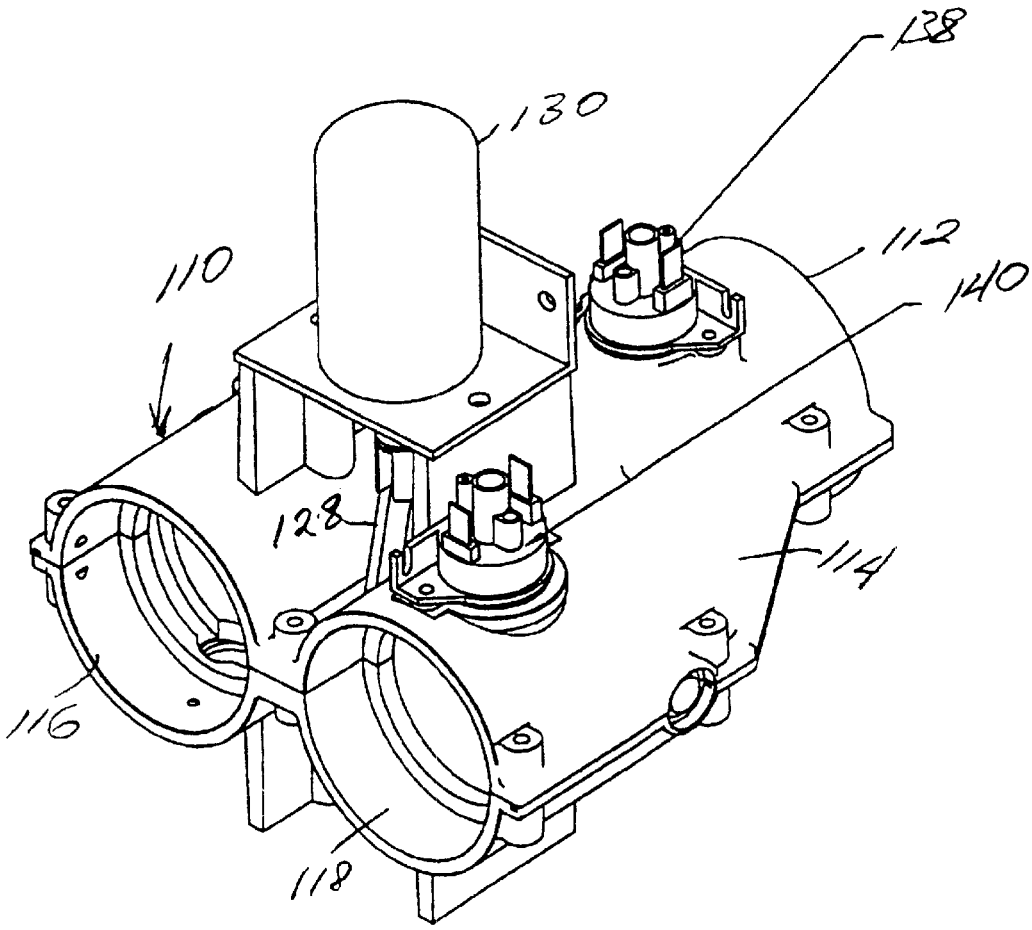
FIG. 10 is a perspective view of an air valve.
Figure 11:
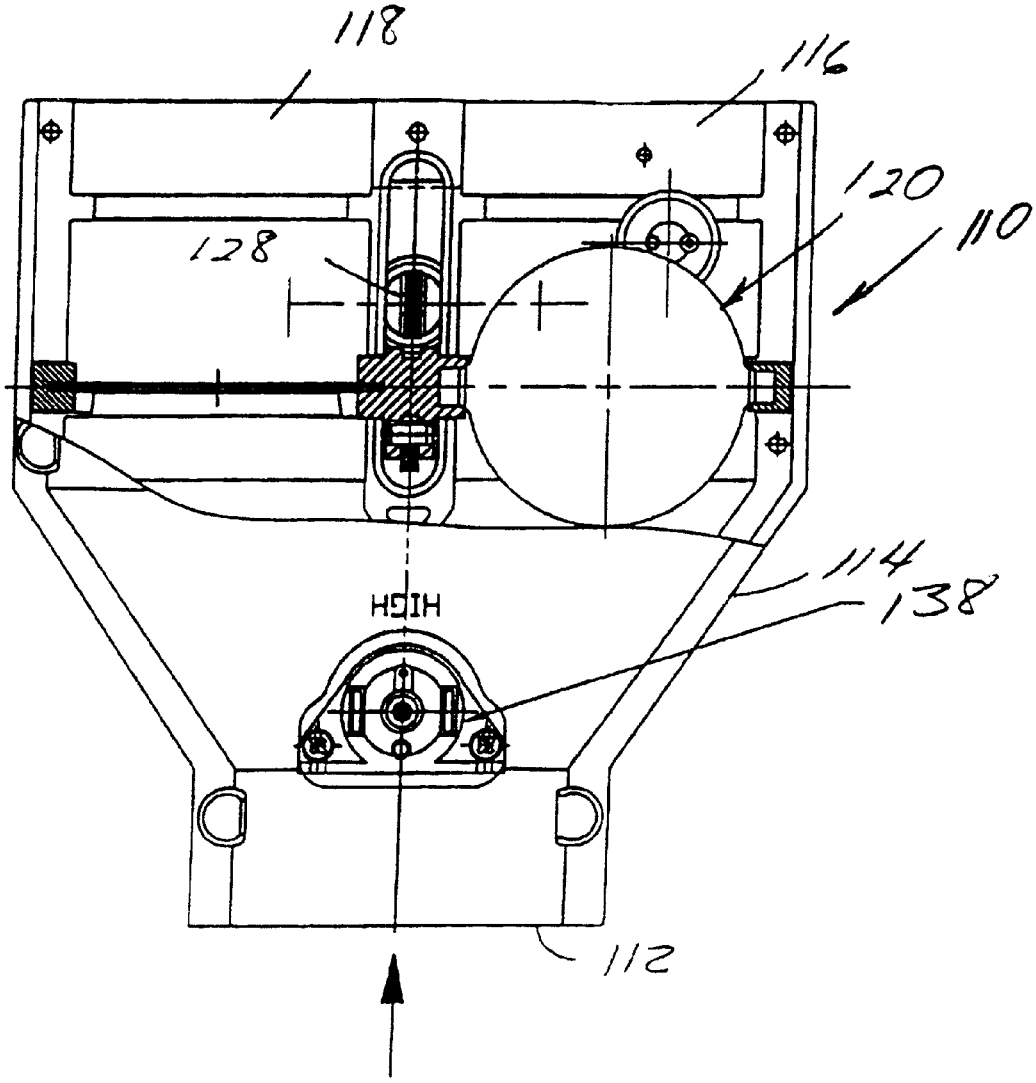
FIG. 11 is a is a plan view of the air valve.
Figure 12:
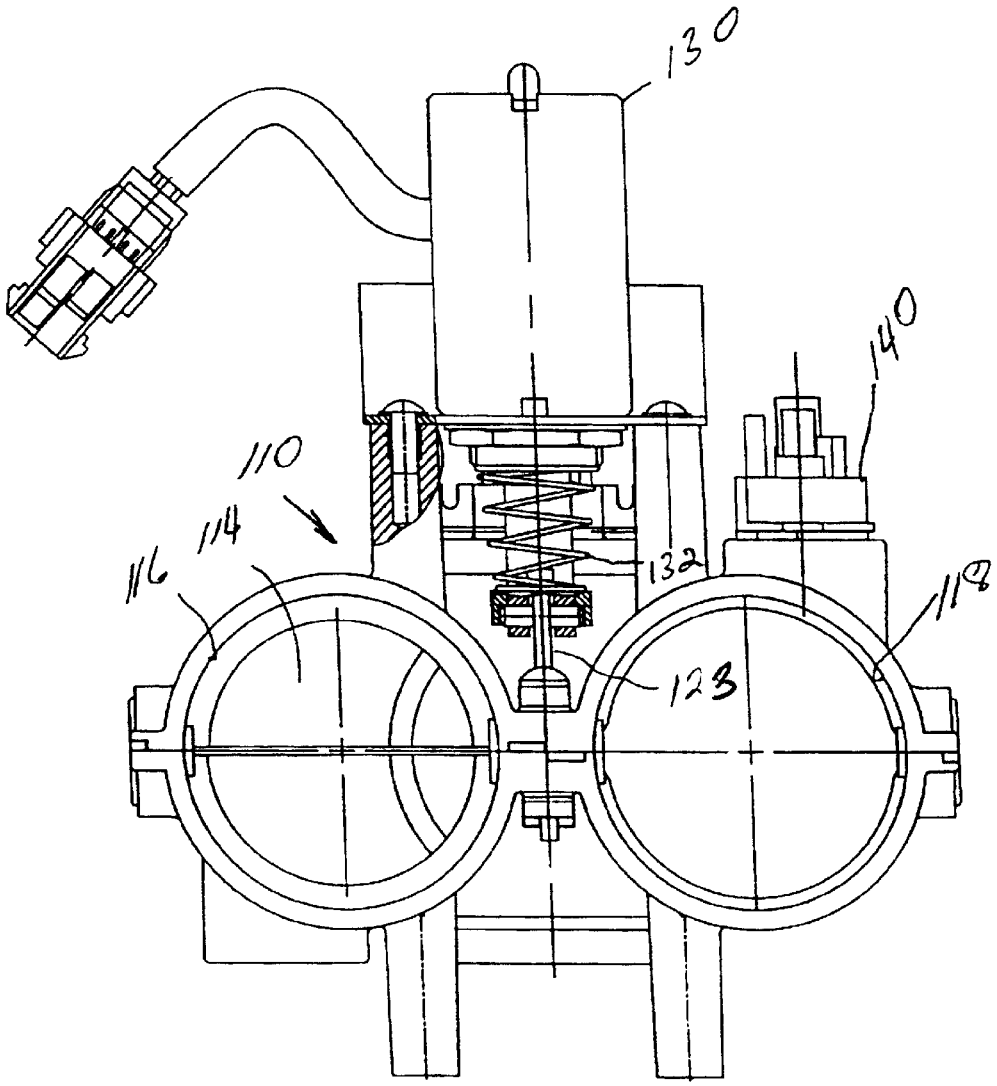
FIG. 12 is a front view of the air valve.
Figure 13:
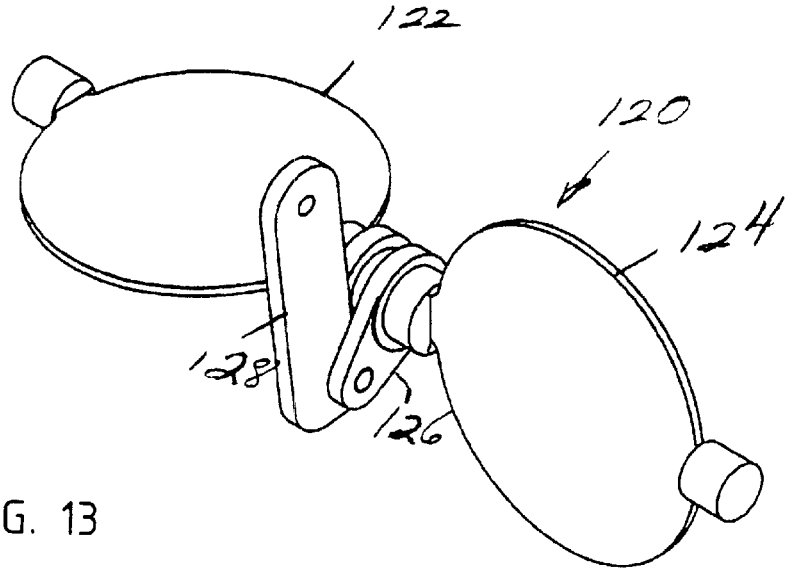
FIG. 13 is a perspective view of a valve element for the air valve.

FIG. 9 illustrates an ice gate 140 which is arranged downstream of the ice outlet 132 from the ice bin 12 and the air supply passage 136 from the blower 106. The ice gate 140 has a passage 142 extending substantially vertically. The passage 142 is coupled at its upper end to the ice outlet 132 defining an ice inlet 144 to the gate 140. An air inlet 146 is open to the passage 142 and is coupled with the air supply passage 136. This inlet 146 is located below the ice inlet 144. An ice and air outlet 148 is then located below the air inlet.

A gate 150 is located in the passage 142. The gate 150 is a flipper valve depending from the body of the ice gate to extend across and close off the air inlet 146 when not forced open by pressurized air, the closure of the air inlet 146 providing one extreme position for the gate 150. When the air is fully pressurized and flowing through the air inlet 146, the gate 150 is blown over to close the passage 142. As the gate 150 is longer than the width of the passage 142, the gate 150 will extend across the passage 142 without binding or blowing open in the opposite direction. This forms another extreme position for the gate. With this operation, when the air is off, ice can be dropped down into the ice and air outlet 148. When the pressurized air is on, that pressurized air communicates with the ice and air outlet 148 and is prevented from blowing back and into the ice inlet 144 which is the ice outlet 132 of the ice bin 12.

Returning to FIG. 1, below the ice gate 140, the ice and air outlet 148 of the ice gate 140 is coupled with an ice transport conduit 152 which forms a plurality of coils 154 below the ice gate 140. The ice transport conduit 152 then may extend upwardly to an appropriate level for distribution to individual ice stations. Naturally, the direction of the ice transport conduit 152 is determined by the relative location of the ice bin 112 relative to the stations.

Figure 15:
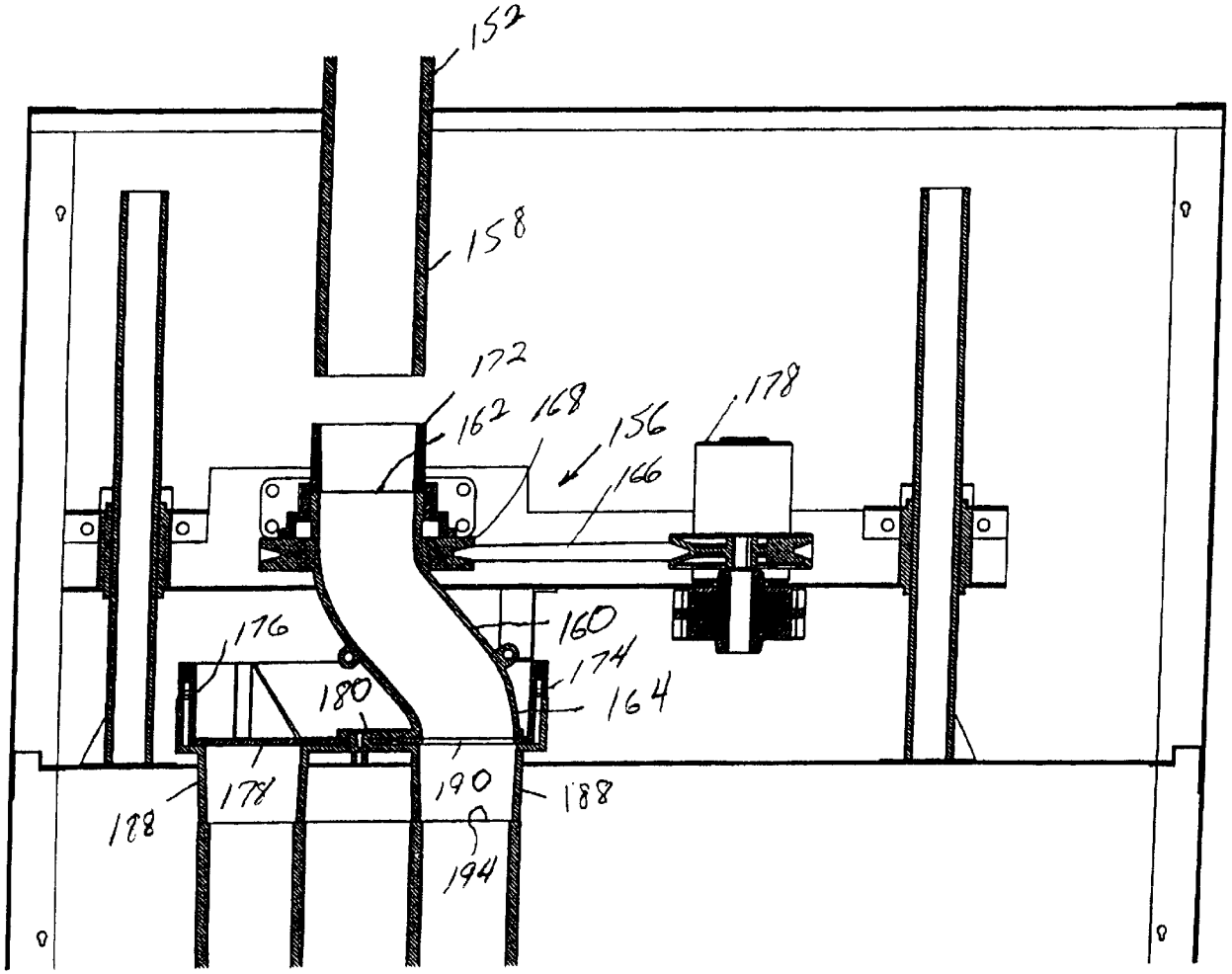
FIG. 15 is a cross-sectional side view of a diverter.
Figure 16:
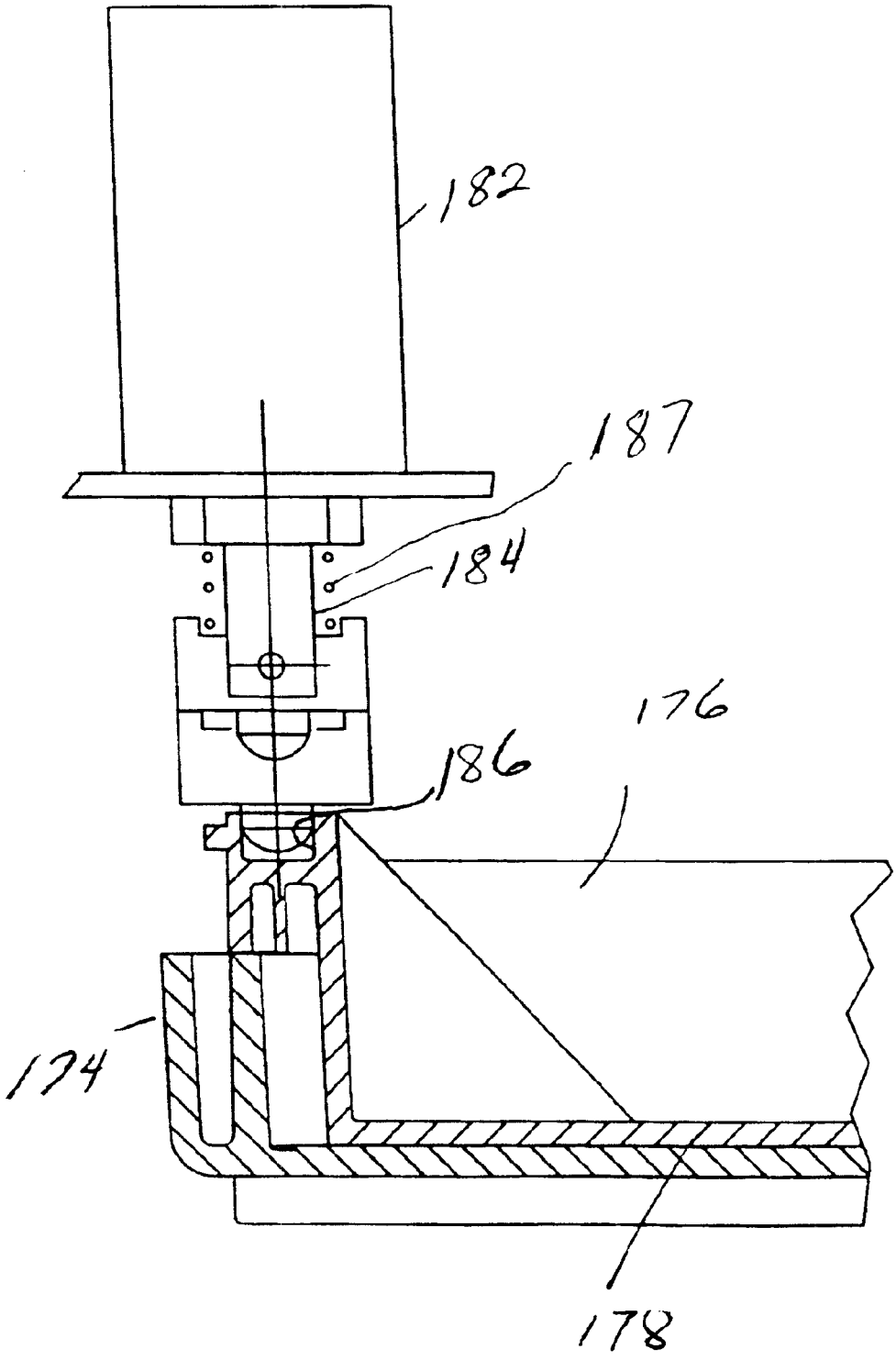
FIG. 16 is a cross-sectional side view of a indexing assembly for the diverter.
Figure 17:
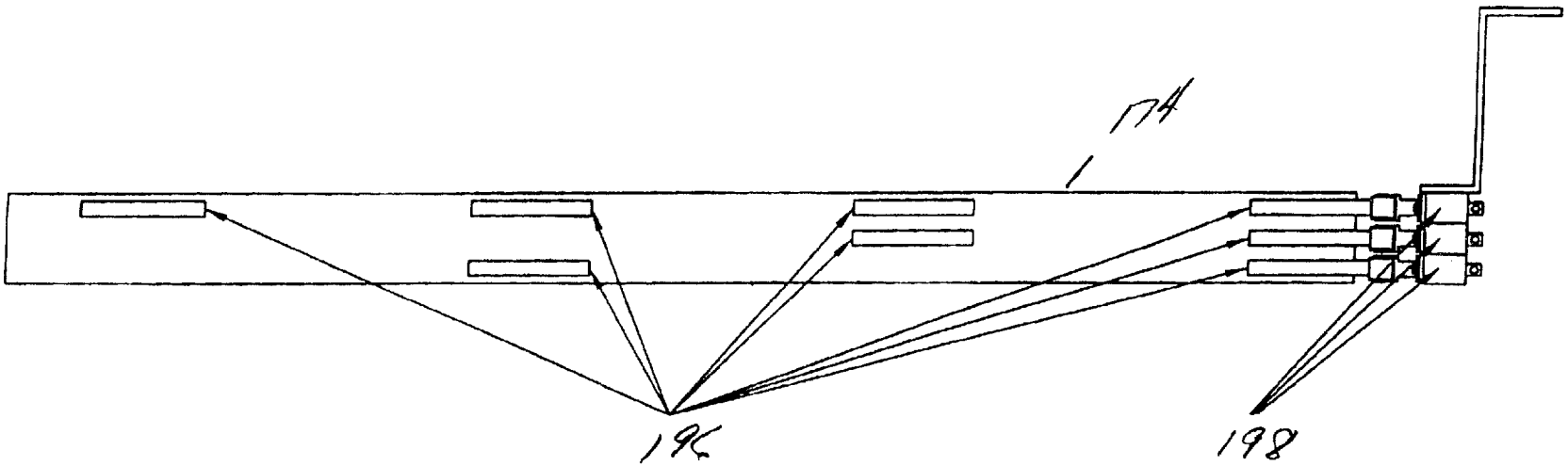
FIG. 17 is a position sensing system of the diverter.
Figure 18:
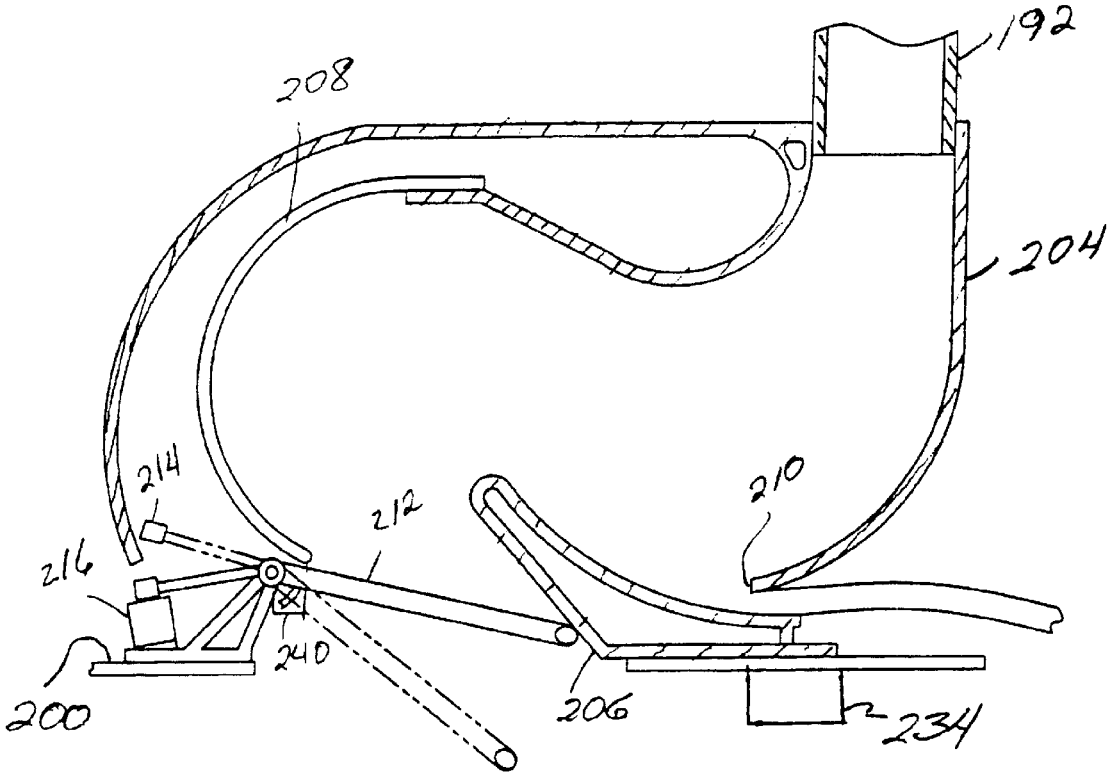
FIG. 18 is a cross-sectional side view of a receiving station pre-chamber.

The ice transport conduit 152 extend to a multi-station diverter 156. The multi-station diverter 156 is best illustrated in FIGS. 15, 16 and 17. The ice transport conduit 152 is arranged to terminate at the multi-station diverter 156 with a diverter approach portion 158 which extends vertically downwardly to the multi-station diverter 156.

The multi-station diverter 156 includes a diverter tube 160. The diverter tube 160 is rotatably mounted about a vertical axis. An inlet end 162 of the diverter tube 160 is concentric with that rotational mounting axis. An outlet end 164 is displaced from the axis by a first distance. The diverter tube 160 is driven by a V-belt 166 cooperating with a pulley 168 fixed to the tube 160. A motor 170 drives the rotation.

In addition to the concentric mounting 172 at the inlet end 162 of the diverter tube 160, mounting is provided by a body 174 which is circular in plan with cylindrical sidewalls 176 and a circular plate 178. The circular plate 178 concentrically receives a mounting pin 180 which forms a part of a support for the body 174.

Indexing of the multi-station diverter 156 is provided by the mechanism best illustrated in FIG. 16. A solenoid 182 retracts a spring biased actuated pin 184 from sockets 186 located in the upper rim of the cylindrical sidewall 176. The spring 187 otherwise extends the actuated pin 184 to one of the sockets 186 to retain the multi-station diverter 156 in registry with one of the distribution conduits to remote dispensing stations.

The multi-station diverter 156 extends to diverter discharge portions 188 which transition to distribution conduits. The diverter discharge portions 188 are displaced from the axis of rotation of the diverter tube 160 of the multi-station diverter 156 by a distance equal to the displacement of the outlet end 164. Thus, the outlet end 164 is able to align with the diverter discharge portions 188. The circular plate 178 includes a port 190 therethrough aligned with the outlet end 164 of the diverter tube 160. As there are multiple diverter discharge portions below the circular plate 178, the remaining discharge portions are covered over when one is aligned with the port 190.

Looking momentarily to FIG. 1, distribution conduits 192 extend from the diverter discharge portion through distribution conduit inlets 194. These distribution conduits 192 then extend to remote dispensing stations. To cooperate with the diverter discharge portions 188 so as to appropriately feed the distribution conduits 192, the sockets 186 are appropriately located about the rim of the cylindrical sidewall 176 so as to specifically align the outlet end 164 of the diverter tube 160 with each of the diverter discharge portions 188, respectively. To do this, station markers are provided on the periphery of the body 174. These station markers are in the form of cams 196 as illustrated in FIG. 17. The cams uniquely identify each distribution conduit inlet by station sensors which are switches 198 extending into the path of travel of the cams 196. As illustrated in FIG. 17, with three switches 198, several stations can be recognized. Four are illustrated. However, a fifth could be added through cams 196 located in the middle and bottom positions. A sixth station can be recognized by a single cam located in the bottom position. Finally, a seventh station can be recognized with a single cam located in the middle position.

Remote ice receiving and dispensing stations 200 are located at the ends of the distribution conduits 192. These stations are receiving stations for ice and provide conventional ice storage bins 202 with conventional dispensing equipment therefrom. FIGS. 18 through 22 illustrate a prechamber and the mechanism thereof for an otherwise conventional remote dispensing station 200. A chamber 204 receives ice and conveying air from a distribution conduit 192. The chamber 204 is preferably an S-shape in cross section with a first end of the S extending to be coupled with the outlet end of the distribution conduit 192 and a second end extending down to be coupled to a passage 206 into the remote dispensing station 200. The chamber 204 is open to the atmosphere through an air outlet 208. The air outlet 208 may be a series of strips spaced from one another to allow air flow therethrough while capturing all pieces of ice. A first liquid drain 210 is shown to drain the upstream portion of the chamber. The drain entrance is arranged such that ice entering the chamber 204 will not be hung up by the edge of the drain.

A gate 212 extends across the passage 206 into the remote dispensing station 200 to selectively close the passage. The gate 212 is shown to be pivotally mounted with a counterweight 214. Alternatively, a spring may be employed. The counterweight biases the gate 212 toward a position closing the passage. The gate 212 swings downwardly to open under the weight of delivered ice or may be opened by an electromagnetic or pneumatic mechanism. When advantageous, the gate may be locked by an electromagnet 216 attracting a ferromagnetic counterweight 214. A position sensor determines the orientation of the gate 212 as to whether or not it is fully closed.

Figure 19:
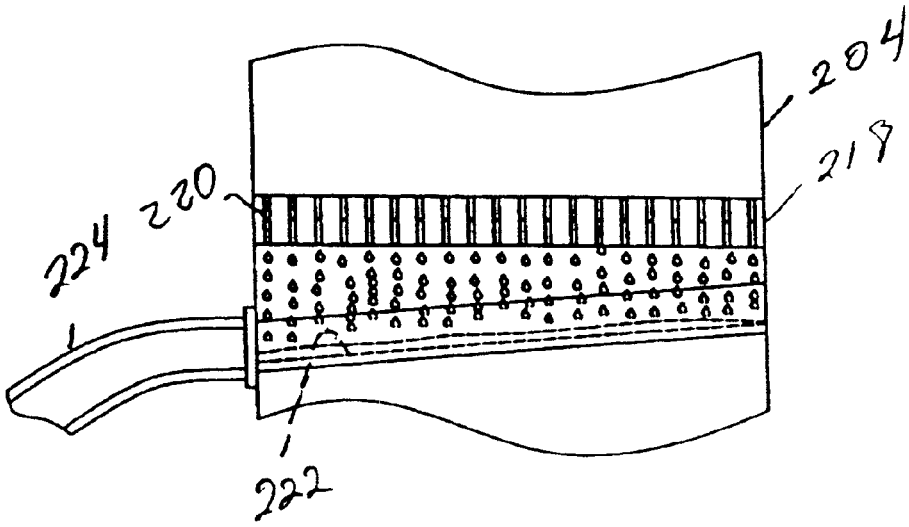
FIG. 19 is a front view of a fluid collector.
Figure 20:
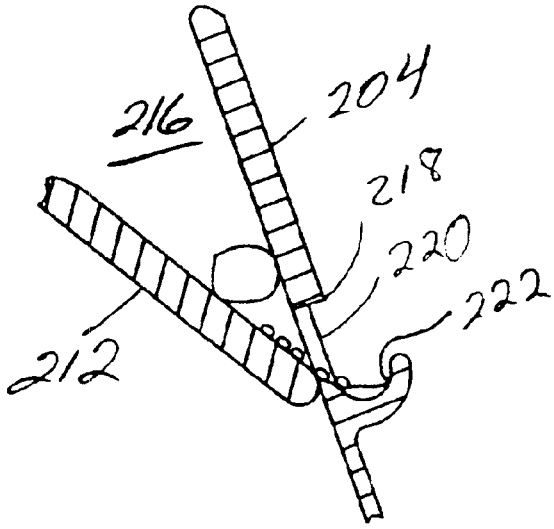
FIG. 20 is a cross-sectional side view of the fluid collector of FIG. 19.
Figure 21:
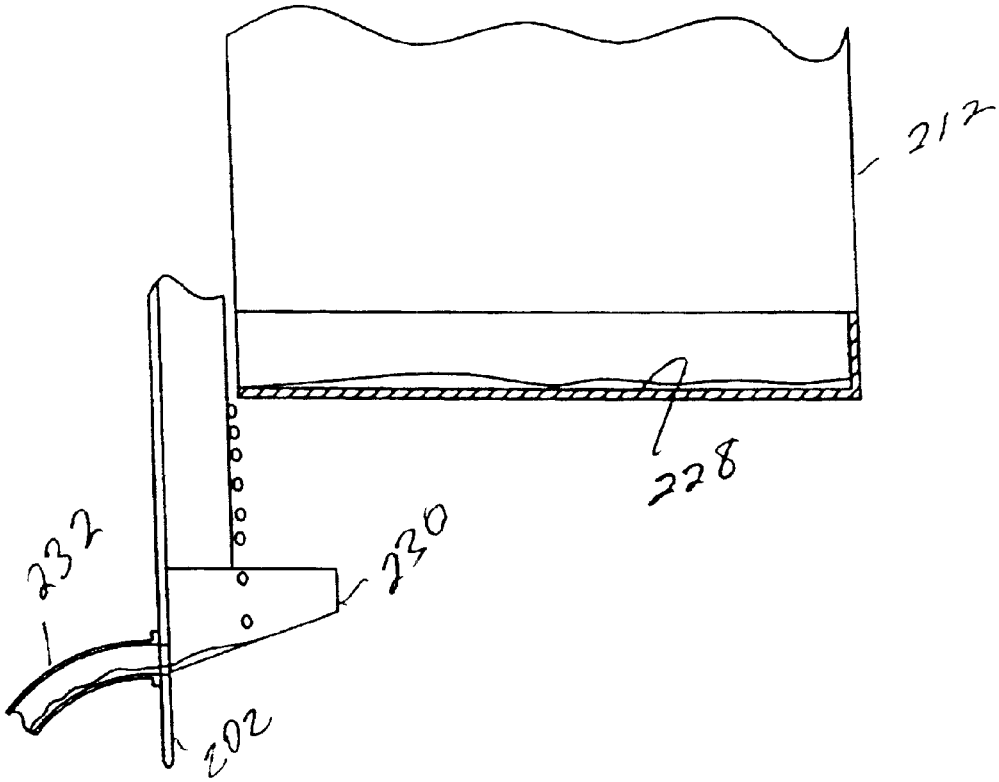
FIG. 21 is a cross-sectional front view of a second fluid collector.
Figure 22:
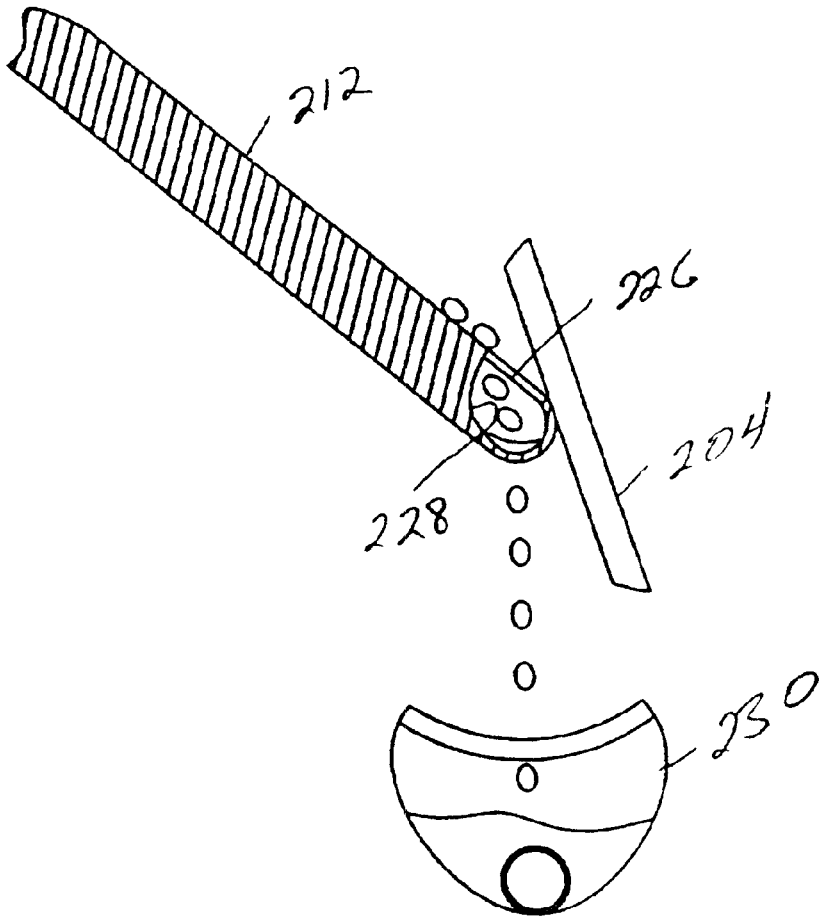
FIG. 22 is a cross-sectional side view of the fluid collector of FIG. 21.

Inhibiting liquids from flowing into the remote dispensing station 200 is advantageous. Such liquids may simply be melted ice but can be cleaning fluid. Therefore, in addition to the liquid drain 210, a further liquid drain is advantageously associated with the gate 212. FIGS. 19 and 20 illustrate a first embodiment for such a drain while FIGS. 21 and 22 illustrate a second. In the first embodiment, a liquid drain extends from the end of the gate through the wall of the passage 206. This drain 218 includes bars 220 to prevent ice from flowing through the drain 218. A channel 222 on the backside of the wall of the passage 206 is angled downwardly to communicate with a discharge tube 224.

In the embodiment of FIGS. 21 and 22, the drain from the end of the gate is through a passage in the gate 212 itself. In this embodiment, bars 226 extend from the upper surface of the gate 212, overlaying a channel 228 offset to promote flow to one side of the gate 212 as can be seen in FIG. 21. A cup 230 receives the collected liquid and communicates with a discharge tube 232 to exhaust the liquid away from the ice storage bin 202 of the remote dispensing station 200. For either drain of these two embodiments to work, the gate 212 is to be closed for optimum operation. The second embodiment is better able to capture liquid even if there is a slight opening of the gate 212 within the passage 206.

The foregoing structure is preferably configured for operation with a controller. An electronic or microprocessor-based control system is preferred. The controller is contemplated to specifically control the mode of operation of each element and to provide responses to specific events. Several sensors are used with the controller to trigger control operation.

Looking first to the ice bin 12, the controller is employed to operate both the drive 54 which actuates the agitators 46 and 48 and the drive 78 which actuates the agitators 62 and 64. During normal operation, the drives 54 and 78 are actuated on a periodic basis to define a first periodic cycle for the drive 54 and a second periodic cycle for the drive 78. The first drive 54 is cycled approximately once ever ten cycles of the second drive. Further, the first drive only moves a part of a revolution with each cycle. This motion is sufficient to insure that the ice is able to move downwardly toward the outlet. The partial revolution is enough to break any bridges and columns which may form in the upper or lateral portions of the ice bin 12. The drive 78 is actuated at a substantially greater frequency but is contemplated to have the same approximate duration of agitator rotation per cycle as the first drive 54. The second drive also moves the agitators less than one full rotation per cycle. The controller also regulates operation of the auger 36 through the drive motor 44. The signal from the reed switch 84 indicative of a failure of one or more of the agitators to rotate provides input to the controller as does the microswitch 102 of the motor torque sensor. The ice bin 12 may also include a sensor to determine the amount of ice in storage. The amount may be used to control the source of ice 10, either through the controller or directly. Such a sensor could be electronic or mechanical.

The controller energizes the solenoid 130 of the air directional valve 110 to direct air selectively through the outlets 116 and 118. The controller might also turn the blower 106 on and off based on the time of day or responsive to volume of ice distribution. Input to the controller is received from the high pressure switch 138 and the low pressure switch 140 associated with the air directional valve 110. The solenoid of the valve 130 is also to be actuated by the controller.

The positioning of the diverter tube 160 of the multi-station diverter 156 is also positioned through the motor 170 by the controller. As greater alignment accuracy is necessary for the diverter tube 160 than is conventionally provided by the motor 170, the controller also lifts and releases the actuated pin 184 through control of the solenoid 182. Positional information regarding the diverter tube 160 is supplied, as described above by the cams 196 and the switches 198. The input from the switches 198 is directed to the controller for feedback on the accurate manipulation of the actuated pin 184.

The controller is programmed to select a new distribution conduit 192 by drawing the actuated pin 184 from the associated socket 186. The diverter drive is then sequentially powered in one direction for a short pulse and then powered in the other direction to a new position at which time the actuated pin 184 can be positioned within a new socket 186. The controller routinely determines which direction of rotation will result in the least movement and, consequently, time. The initial short pulse would then be initiated in the reverse direction so that the main driving of the diverter tube 160 will be along the shortest path to the next position.

At the remote dispensing stations 200, the ice storage bins 202 include ice level sensors 234. These sensors provide signals to the controller indicative of the levels of ice in the bins 202. When the ice level falls below a preset level in one of the bins 202, the sensor associated with the low bin 202 sends a demand call to the controller for additional ice.

The overall condition of the system is tested through the positioning of doors and gates as well as by pressures. The door 24 on the ice bin 12 includes a sensor or switch 236 to indicate to the controller when the door 24 is open. The ice gate 140 includes a sensor 238 on the gate 150 to determine closure of the passage 142. A like device 240 is found on the gate 212 of the remote dispensing stations 200. The controller further energizes the electromagnet 216 when the gate 212 is to remain locked.

The remote dispensing stations 200 preferably include a visible ice level monitor 242 which can be seen from outside the ice bin. Such a monitor may be electronic and coupled with the ice level sensor. Alternatively, a less sophisticated means, such as a sight glass, may be employed. The value of such an ice level monitor is that the bin need not be opened to insure the existence of an adequate supply.

Turning to the operation of the ice delivery system, ice is supplied by the source of ice 10 to the ice bin 12. As noted above, some means for controlling the generation of ice based on the quantity of ice in the ice bin 12 is preferred. This may occur through conventional means such as a mechanical arm or may rely on a sensor through the controller. Also as noted above, agitators within the ice bin 12 periodically move to insure that the body of ice within the bin 12 is able to flow toward the outlet. Only a relatively small amount of agitation is required. Greater amounts of agitation reduce the piece size of the ice and can operate to generate heat within the ice. Ultimately, the ice moves toward the ice outlet 32 at the bottom of the ice bin 12. The auger 36 at the bottom of the ice bin 12, activated by the controller, delivers ice from the ice bin 12 into the passage 142 of the ice gate 140. The controller is programmed to run the auger 36 in a series of intermittent runs to accumulate a full load of ice to be distributed to a remote dispensing station 200. With each run, ice is augered from the bin 12 through the ice outlet 32 and dropped away from the auger. The auger may then be reversed through a partial turn to insure that additional ice is not discharged until the auger resumes the discharging operation.

The ice released from the auger 36 falls through the ice gate 140 to the coils 154. The ice from several periodic runs of the auger are retained in the coils 154 before being transported onto a selected remote station 200. Puffs of air alternate with the auger operation to distribute the ice within the coils 154. During the distribution operation, the blower 106 may be constantly running. Between puffs of air, the air directional valve 110 directs air to the outlet 116. This air may be used to pass over other components which may become hot during operation for cooling purposes. The solenoid 130 is actuated following an auger run. Preferably, a short delay is programmed into the controller between the operation of the auger 36 and the actuation of the air directional valve 110 to blow air into the ice gate 140. The delay may be no more than a second or two from the time the auger 36 ceases to rotate. When the auger reverses direction at the end of each run, the delay would begin from the termination of the reverse rotation of the auger. Following the delay, the solenoid 130 is pulsed to open the air directional valve 110. Where employed, the valve 138 would also open.

The puff of air from the blower 106 directed by the air directional valve 110 to the ice gate 140 is directed through the air inlet 146 to close the gate 150 and flow through the ice and air outlet 148. The closure of the gate is monitored by a sensor 238. If, during the puff of air, the gate 150 does not close, there is an assumption that ice is blocking the gate 150 from closure. With an open gate signal, the auger 36 is not further enabled. Rather, the air directional valve 110 is cycled to provide repeated puffs of air to the ice gate 140 so as to enable and test for full closure of the gate 150. Once closure is sensed, the system may again returns to a cycle of alternating augering and puffing. Alternatively, the need to induce full closure of the gate may suggest the possibility of other concerns with the condition of the flow paths. Consequently, before returning to normal operation, a long pulse of transporting air may be generated to send the batch currently being accumulated in the coil 154 to a remote station. The pulse may be controlled by the shorter of a timed amount sufficient for the batch or partial batch to reach the remote station or a pressure drop signaling arrival of the ice at a remote station. A pressure drop may not be sensed if the batch accumulated in the coil 154 was small when the open ice gate was sensed. A solenoid might also be employed to supplant the use of air to close the ice gate.

A pressure sensor downstream of the ice gate 140 may also be employed to sense sufficient closure of the gate 150 to allow continued operation. The controller may accept one or the other of a gate closure signal or a minimum pressure signal to continue ice distribution from the auger 36. The differential pressures may be enhanced through the storage of pressure in the source of transporting air through the valve 138 with rapid release of that pressure from the source of transporting air in the direction of the ice dropped from the auger by a rapid opening of the valve 138. Once a preselected number of auger runs have been performed, the amount of ice within the coils 154 is ready to be discharged to a selected remote dispensing station 200. The controller then activates the valve element assembly 120 through the solenoid 130 to send a long pulse of transporting air in the direction of the ice dropped from the auger 36. The high pressure switch 138 on the air directional valve 110 measures the back pressure as the ice is transported to a remote distribution station. A pressure drop in the line signals that the ice has been appropriately distributed. The transporting air is supplied for a few seconds after the pressure drops to insure that all pieces of ice are appropriately distributed.

The ice level sensors 234 within the remote dispensing stations 200 signal the controller when the ice has lowered to a level requiring more to be supplied. The controller recognizes which remote dispensing station 200 is indicating a low level of ice and activates the multi-station diverter 156. The controller is continuously supplied with the diverter position based on the status of the switches 198. When a remote dispensing station 200 calls for ice, the multi-station diverter position to accomplish satisfying the need for ice is determined. The direction of rotation of the diverter tube 160 to move the shortest distance to the appropriate station is determined. A small reverse pulse is initiated in the opposite direction and the solenoid 182 withdraws the actuated pin 184 from the socket 186. The diverter tube 160 is then rotated in the appropriate direction to reach the next station. The cams 196 and switches 198 indicate arrival at the appropriate station and the controller releases the actuated pin 184 to drop into the appropriate socket 186. Once this occurs, ice distribution can begin.

The gate 212 of each of the remote dispensing stations 200 is biased to a closed position by the counterweight 214. The sensor 240 indicates gate closure and the gate may be locked in this position by an electromagnet 216. When the gate 212 does not fully close, there can be an indication of ice blocking the passage 206. When ice is transported, the gate 212 opens under the weight of the ice. The air may continue for a time after the batch of ice has been delivered, signaled by a drop in pressure, to insure clearance of the passage and the chamber 204. If the gate 212 does not close at this time, the system is disabled from providing additional ice to the remote station 200 until the gate 212 closes. Further delivery of air without ice may be provided if the station 200 continues to call for ice. The sensor 240 may also be employed to indicate the ability of the gate 212 to fully open. When the gate is unable to fully open, it is assumed that the ice storage bin 202 is full. In either case, the system is disabled from delivering ice to the remote dispensing station 200 where the gate 212 can either not fully close or not fully open.

A number of operating modes and conditions are also recognized by the controller. The controller continually senses the state of closure of all ice bin access doors. With the opening of any such access door associated with an ice bin, the system is disabled. Thus, augering of ice, blowing puffs of air and blowing transporting air are disabled with an open ice bin access door. When this occurs, the system preferably operates to reinitialize. This also occurs with power failure and with initial startup of the system.

Upon initializing, the system may be actuated to provide a test puff of air. The test puff would be used to determine the amount of back pressure in the system. Alternatively, a transporting cycle for a fixed period of time might be employed where transporting air is blown through the system to insure that no ice is present. The puff or transporting cycle might be employed with each remote station 200 when it initially requests ice. Such testing is considered unnecessary after the initial delivery of ice to a given remote station 200 during any series of deliveries to the same station. This is because each delivery is verified to be complete when the characteristic pressure drop is sensed with the ice leaving the transport conduit 152. The auger 36 would be disabled until such time as pressure within the system drops below a preselected minimum. Repeated cycling may be employed in an effort to clear the system when pressure exceeds the minimum. During the test distribution of air, the gates 212 are preferably maintained in the closed position. This avoids the blowing of transporting air into the associated ice storage bins 202.

The system contemplates cleaning and drying cycles which may be manually commanded or periodically initiated by the controller. The cleaning cycle is provided to allow the passage of a device through the pneumatic tubing which distributes cleaning fluid as it passes along. With such a cycle, the gates 212 would remain closed at all times. The cleaning device containing the cleaning fluid might be introduced at the ice gate 140 and driven by the blower 106. The device would then end up in one of the chambers 204 of a remote dispensing station 200. The process may be repeated with the diverter tube 160 of the multi-station diverter 156 repositioned to access additional distribution conduits 192. The use of the blower 106 to propel the device through the pneumatic tubes would result in closure of the gate 150 of the ice gate 140. As a result, the ice in the ice bin 12 would not be heated by the flow of air therethrough. The same is true for the ice storage bins 202 through locking of the gates 212 by the lock 216. An identical configuration is used for drying the distribution system but for the passage of a cleaning device through the pneumatic tubes. A periodic drying of the system helps to reduce organic contamination.

Rather than a cleaning device, the vehicle used for conveying an active agent may be a batch of ice itself. Liquid or gas cleaning, de-scaling or sanitizing agents may be introduced at any location. Introduction into the ice gate 140, either through the ice inlet 144 or the air inlet 146 or both, of such liquid or gas agents may be conveyed with a batch of ice through the system. Alternatively, small amounts of agent may be released during normal operation.

Where the agent is such that it would make the stored ice in the remote stations 200 less desirable if it was allowed to enter the ice storage, the gate 212 may be locked in the closed position, even with a batch of ice as the delivery vehicle. Continued air flow would melt the ice to some extent in the prechamber 204 and carry the agent with the water through the drain 210 or one of the drains associated with the gate 212 illustrated in FIGS. 19 through 22. Such a process may be scheduled for automatic actuation on a periodic basis, by number of batches, say once in every 2000 batches, or by lapse of time. The actuation may also be scheduled for times when ice is not being demanded from the remote stations 200.

The distribution of ice through the pneumatic tubes from the ice bin 12 to the remote dispensing stations 200 has been found to be quite sensitive to any blockage within the system. Consequently, ice delivery system conduit couplings must be appropriately designed to avoid any disruption in the passage of the ice. Further, cleanliness at any break or crevice within the tube is of concern. A number of embodiments of ice delivery system conduit couplings are disclosed in FIGS. 23 through 29.

Figure 23:
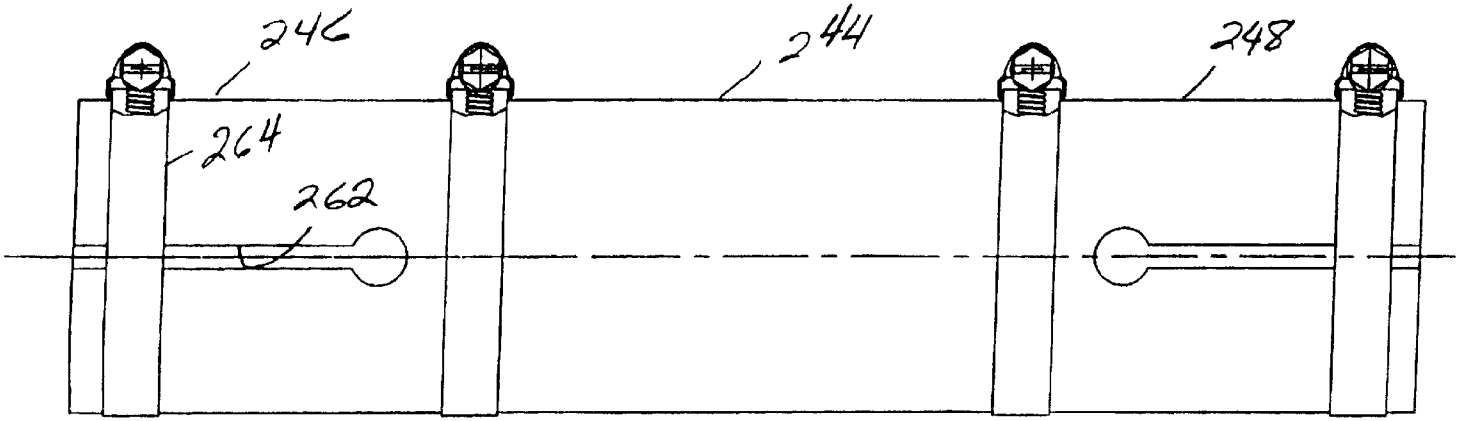
FIG. 23 is a plan view of a conduit connector.
Figure 24:
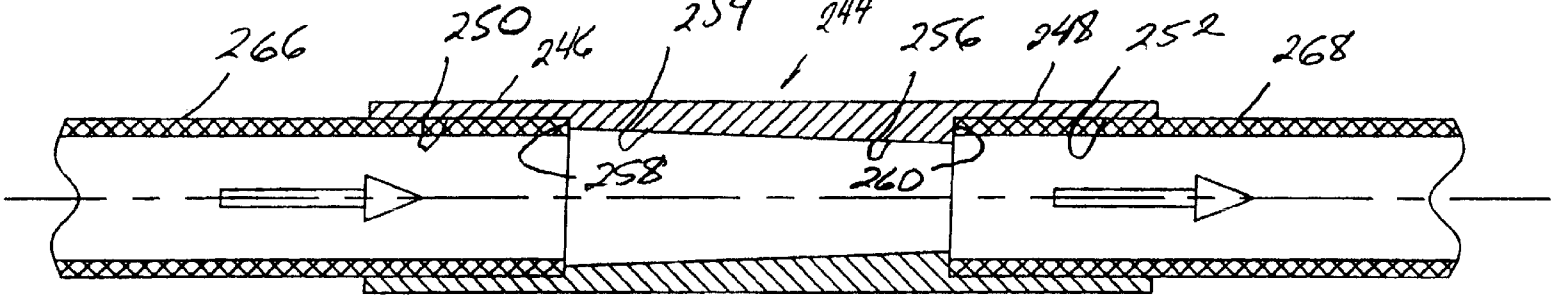
FIG. 24 is a cross-sectional side view of the conduit connector of FIG. 23.

A first embodiment of an ice delivery system conduit coupling is illustrated in FIGS. 23 and 24. The coupling is preferably circular in cross section and is shown to be an integral tube, generally designated 244. The tube 244 is integral in the embodiment of FIG. 24 but is defined in two sections for purposes here as having a first end portion 246 and a second end portion 248. The first end portion 246 includes a tubular clamp section 250 while the second end portion 248 includes a tubular clamp section 252. Between the two clamp sections, the end portions 246 and 248 define tubular extension sections 254 and 256. These sections 254 and 256 include an inner truncated conical surface which is continuous in the embodiment of FIG. 24. These tubular extension sections 254 and 256 include outwardly facing inner shoulders 258 and 260. Between these shoulders, the inner surface of these sections defines a truncated conical surface with the diameter decreasing from the shoulder 258 toward the shoulder 260. As illustrated in FIG. 23, the tubular clamp sections 250 and 252 are partially split longitudinally. The slits 262 are formed with a lateral dimension such that the tubular clamping sections 250 and 252 may be compressed diametrically. As can be seen in FIG. 23, band clamps 264 may be strategically positioned to compress the tube 244. Channels may be provided to receive the band clamps and maintain them in position. In FIG. 24, conduits 266 and 268 are shown in place abutting into the outwardly facing shoulders 258 and 260. From FIG. 24, it can be seen that the conduit 266 has a smaller inner diameter than the adjacent inner shoulder 258 while the conduit 268 has a larger inner diameter than the adjacent shoulder 260. As ice flows from the left toward the right in FIG. 24, it can be seen that no shoulder extends into the ice path using this configuration.

Figure 25:
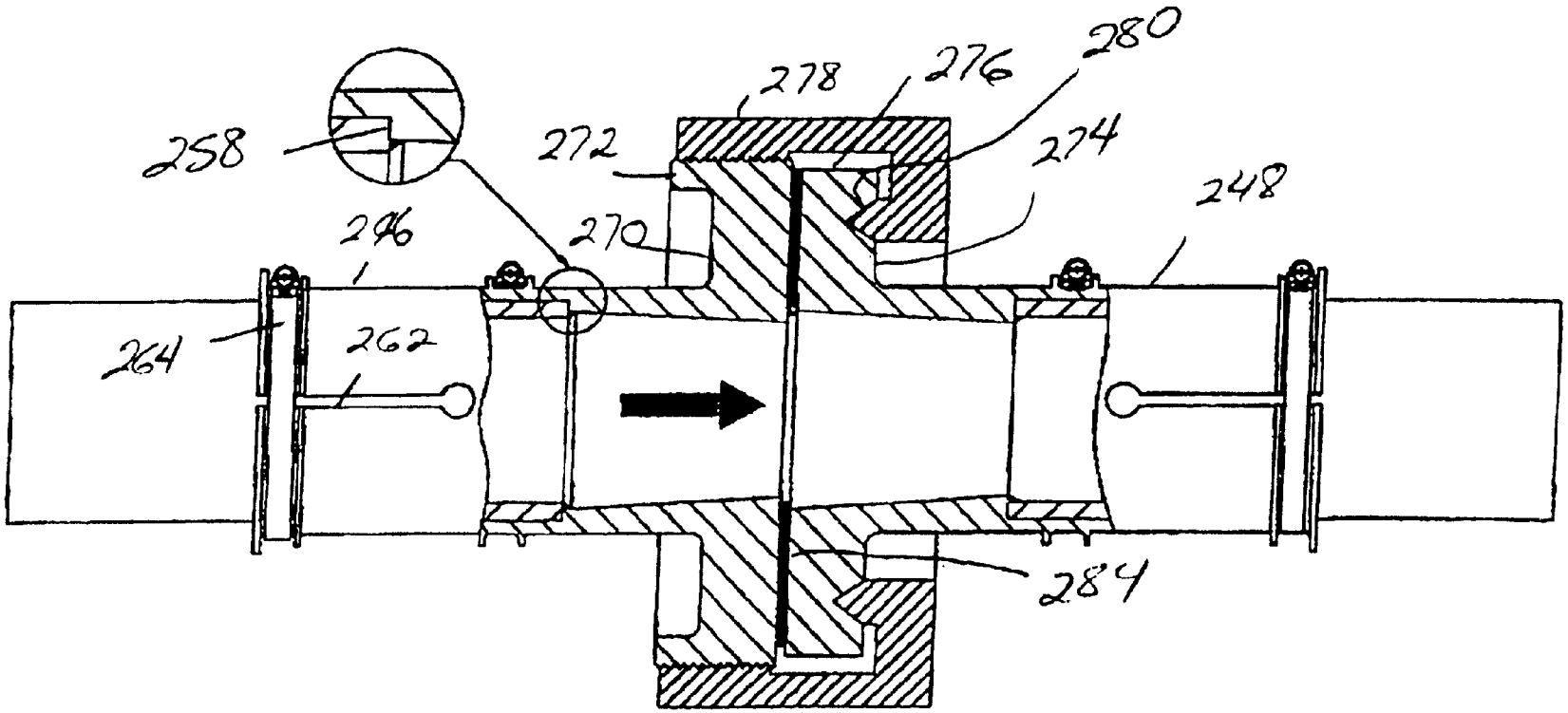
FIG. 25 is a cross-sectional side view of the conduit connector of FIG. 23 with a coupling.

As noted, the embodiment of FIG. 24 shows a continuous inner surface between the shoulders 258 and 260. In the embodiment of FIG. 25, the first end portion 246 and the second end portion 248 are split. The first end portion 246 includes a first attachment 270 defined by an annular outwardly extending flange 272 with threads about the outer peripheral surface thereof. A second attachment 274 provides a second flange 276 of slightly smaller outer diameter. An engagement 278 is defined by a locking nut having an annular inner flange 280 to mate with an annular channel on the flange 276. Inner threads then mate with the threads on the outer periphery of the flange 272 to tighten the two components together. A sealing element 284 is positioned between the two attachments 270 and 274. Silicone sealant may be provided at appropriate part lines. In the embodiment of FIG. 25, the inner surfaces of the tubular extension sections 254 and 256 are shown to be truncated conical surfaces which are, in this case, not continuous. Again, no inner shoulder extends into the path of ice flowing from left to right as seen in FIG. 25.

Figure 26:
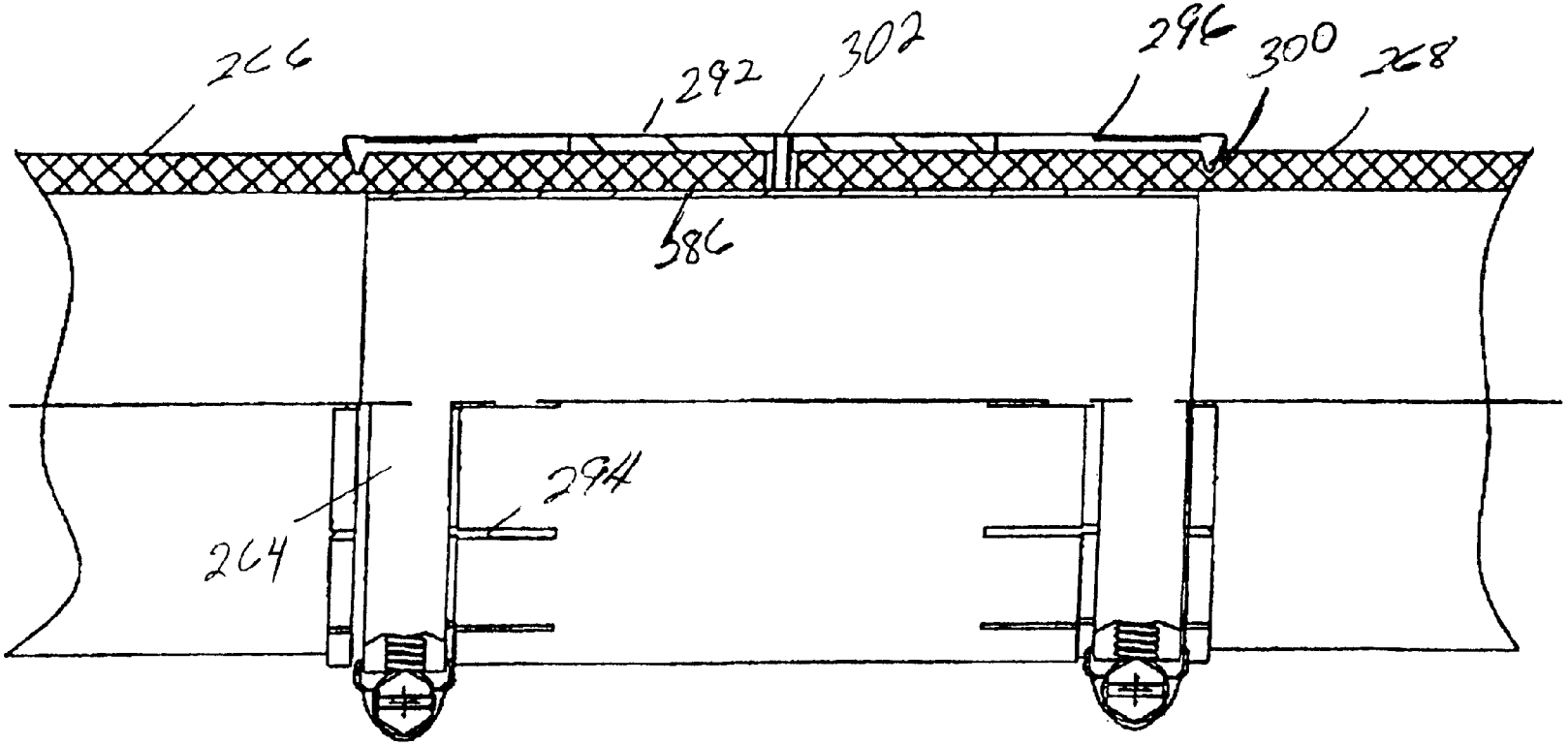
FIG. 26 is a side view in a partial cross section of a second conduit connector.
Figure 27:
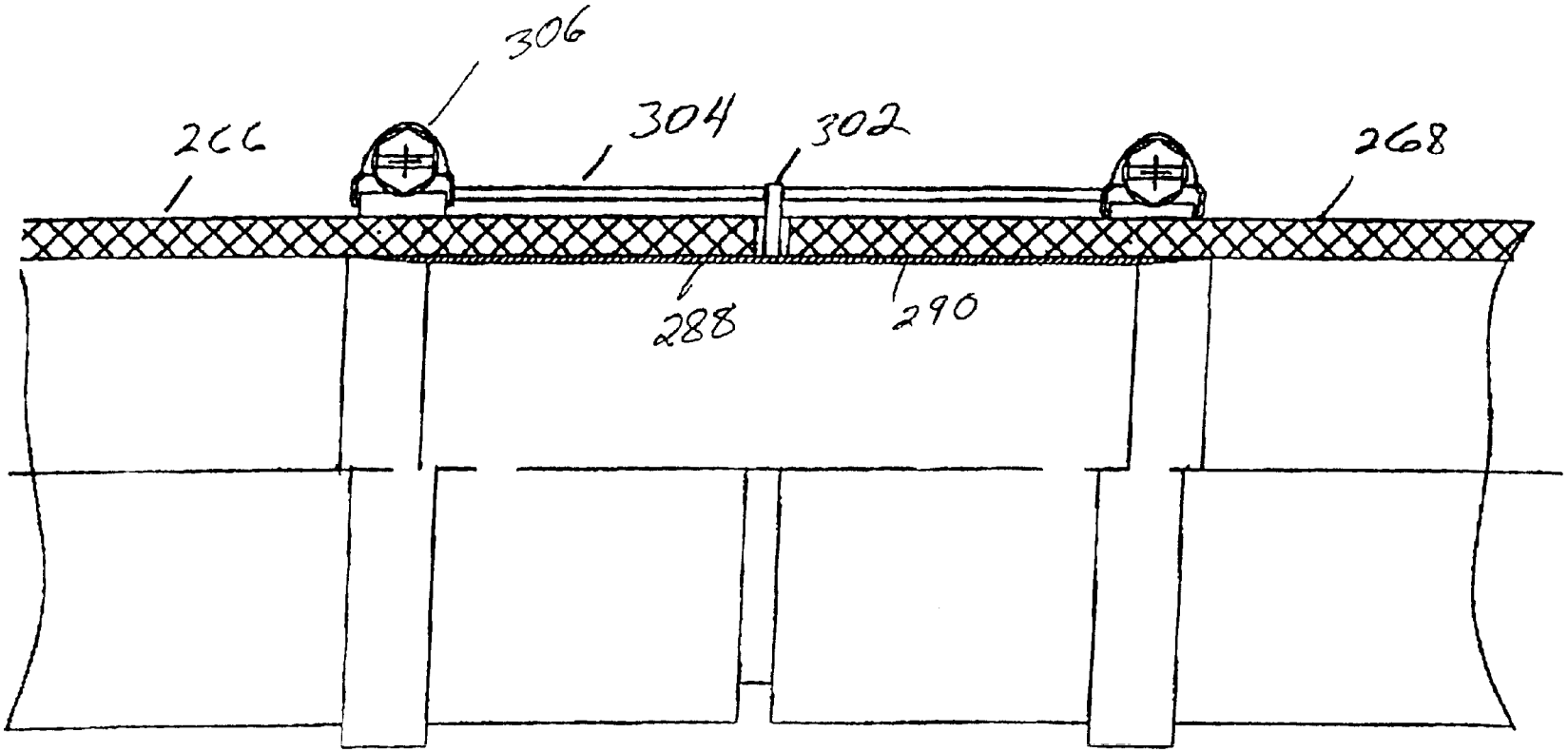
FIG. 27 is a side view in partial cross section of a third conduit connector.

The embodiment of FIG. 26 illustrates an ice delivery system conduit coupling which includes a coupling tube 286 which easily fits within two conduits 266 and 268. The coupling tube 286 is of fairly thin wall to avoid disruption of ice flow. A coupling tube 288 as seen in another embodiment shown in FIG. 27 is contemplated to be employed with the embodiment of FIG. 26 as well. The tube 288 has an inner surface 290 which is flared at the ends to further reduce any shoulder which may be found in the final assembly. In the embodiment of FIG. 26, a clamp sleeve 292 circular in cross section extends around the coupling tube 286. The clamp sleeve 292 has longitudinally split ends where the slits 294 have width to allow for compression of the ends of the clamp sleeve 292. Circumferential channels 296 accommodate clamp bands as shown. At or near the ends, annular sealing flanges 300 extend radially inwardly. When the clamp bands 298 are tightened, the annular sealing flanges 300 both bite into the conduits 266 and 268 and compress the conduits inwardly. This compression forces the conduits 266 and 268 to cover over the shoulders at the ends of the coupling tube 286. To insure that the coupling tube 286 fits within the clamp sleeve 292 and between the annular sealing flanges 300, a pin 302 extends between the coupling tube 286 and the clamp sleeve 292. The conduits 266 and 268 are introduced by sliding axially between these components.

In the embodiment of FIG. 27, the clamp sleeve of FIG. 26 is abbreviated to include one or more strips 304 which extend from the pins 302 coupled with the coupling tube 288 outwardly to clamp band assemblies 306. With the strips 304, the clamp band assemblies 306 are properly spaced to be at the ends of the coupling tube 288 to properly seal the interior. In all cases, silicone may act as a sealant to insure complete closure and the avoidance of cracks and interstices which may harbor organic growth.

Figure 28:
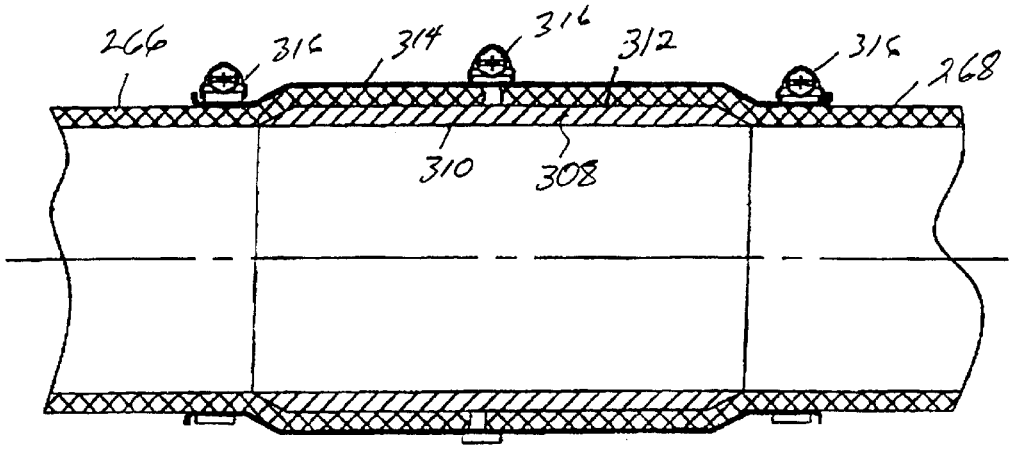
FIG. 28 is a cross-sectional side view of a fourth conduit connector.
Figure 29:
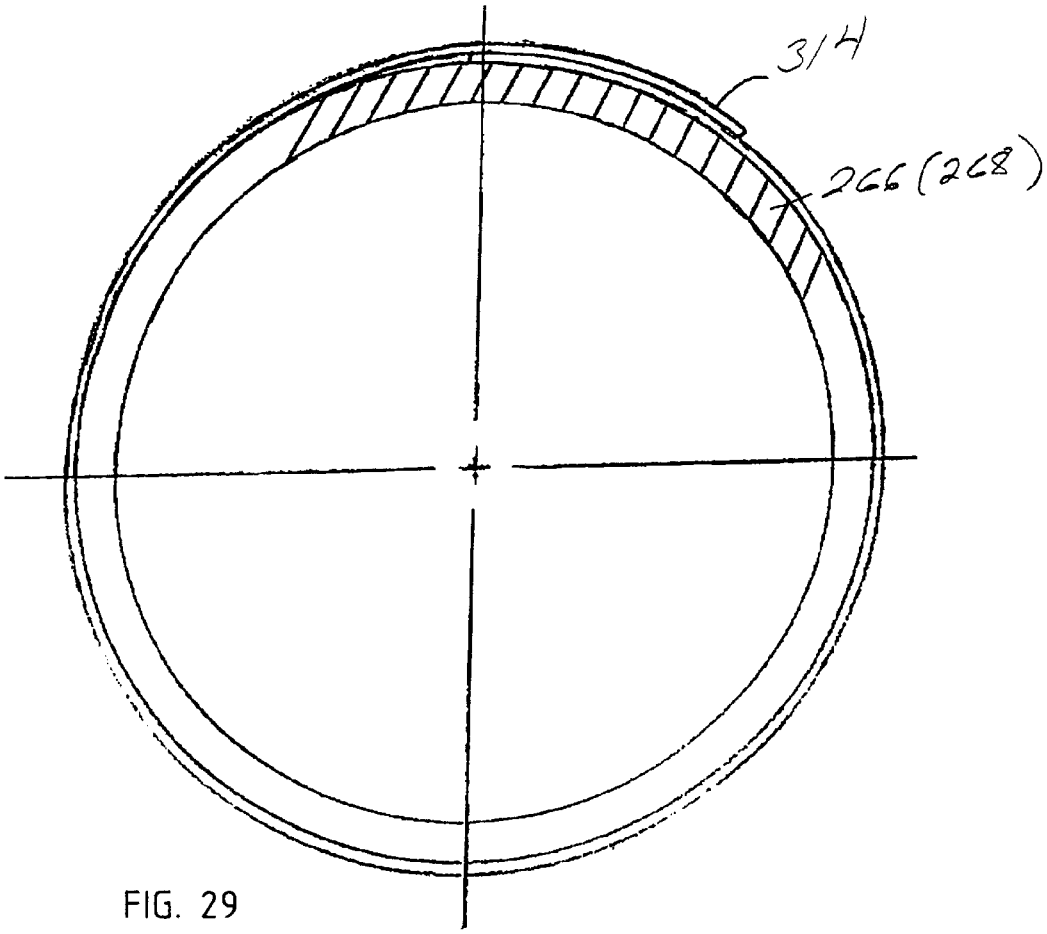
FIG. 29 is an end view of the outer sleeve of the conduit connector of FIG. 28.

The ice delivery system conduit coupling of FIGS. 28 and 29 includes a tubular insert 308 which is shown to be unitary in construction. In this instance, the tubular insert 308 is shown to partially expand the conduits 266 and 268 when placed over the insert 308. Alternatively, the conduits 266 and 268 may be preflared to allow a smooth sliding fit with the outside diameter of the insert 308. The insert is circular in cross section. The insert 308 includes an internal surface 310 which is generally cylindrical but may include a slight flaring at the outer ends thereof. The external surface 312 is also substantially cylindrical but is tapered inwardly at the upstream and downstream ends. A longitudinally split sleeve 314 which may be formed as indicated in FIG. 28 is wrapped about the section of the conduits containing the tubular insert 308. Band clamps 316 tighten the longitudinally split sleeve 314 to draw the conduits 266 and 268 down to immediately overlay the tapered ends of the external surface 312 of the tubular insert 308. In this way, a continuous inner surface across the coupling can be achieved. Again, silicon sealant may be employed where appropriate. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An ice delivery system comprising a source of ice;

an ice bin having an ice outlet from the bin;

a controller;

a set of at least one bin agitator rotatably mounted in the bin and including a first drive coupled with the set of at least one bin agitator, the controller turning on and off the first drive to rotate the set of at least one bin agitator in a first periodic cycle;

a set of at least one discharge agitator rotatably mounted in the bin between the outlet and the set of at least one bin agitator and including a second drive coupled with the set of at least one discharge agitator, the controller turning on and off the second drive to rotate the set of at least one discharge agitator in a second periodic cycle, the frequency of the second periodic cycle being substantially greater than the frequency of the first periodic cycle.

2. The ice delivery system of claim 1, the controller programmed to initiate the first periodic cycle with every tenth second periodic cycle.

3. The ice delivery system of claim 1, the first drive rotating the set of at least one bin agitator less than one full revolution during each first periodic cycle.

4. The ice delivery system of claim 1, the second drive rotating the set of at least one discharge agitator less than one full revolution during each second periodic cycle.

5. The ice delivery system of claim 1 further comprising an induced germicidal environment in the ice bin.

6. The ice delivery system of claim 1 further comprising an auger in the bin extending to the ice outlet from the bin, the auger including a flight of increasing pitch toward the ice outlet.

7. The ice delivery system of claim 1, the set of at least one bin agitator and the set of at least one discharge agitator including at least one rotation sensor coupled with the controller with at least one of the sets of agitators, the controller being programmed to shut off the first drive or the second drive when no rotation is sensed during one of the first periodic cycle or one of the second periodic cycle, respectively.

8. The ice delivery system of claim 1, one of the first drive and the second drive including at least one torque sensor coupled with the controller, the controller being programmed to shut off at least one of the first drive and the second drive when excessive torque is sensed during one of the first periodic cycle or one of the second periodic cycle, respectively.

9. The ice delivery system of claim 1, the duration of agitator rotation during one period of the first periodic cycle being substantially the same as the duration of agitator rotation during one period of the second periodic cycle.

10. The ice delivery system of claim 9, the controller programmed to initiate the first periodic cycle with every tenth second periodic cycle.

11. The ice delivery system of claim 1, the set of at least one bin agitator including at least three bin agitators, at least one of the bin agitators being in the top central area of the bin and at least one of the bin agitators being on each side of the bin, respectively.

12. The ice delivery system of claim 11, the set of at least one bin agitator including six bin agitators, two of the bin agitators being in the top central area of the bin and two of the bin agitators being on each side of the bin, respectively.

13. The ice delivery system of claim 1 further comprising an auger in the bin extending to the ice outlet from the bin, the bin having a V-bottom with the auger located at the convergence of the V-bottom, the set of discharge agitators including first and second discharge agitators substantially symmetrically placed in the bin laterally of the auger and a third discharge agitator located above the auger.

14. The ice delivery system of claim 13, the third discharge agitator including a helical flight thereabout.

15. The ice delivery system of claim 13, the set of discharge agitators further including a fourth discharge agitator substantially symmetrically placed above the third discharge agitator.

16. The ice delivery system of claim 15, the third discharge agitator and the fourth discharge agitator each including an auger element thereabout oriented to move ice away from the ice outlet.

17. The ice delivery system of claim 15, the set of at least one bin agitator including at least three bin agitators, at least one of the bin agitators being in the top central area of the bin and at least one of the bin agitators being on each side of the bin, respectively.

18. The ice delivery system of claim 17, the set of at least one bin agitator including six bin agitators, two of the bin agitators being in the top central area of the bin and two of the bin agitators being on each side of the bin, respectively.

* * * * *